US008152630B2

(12) United States Patent
Cohen

(10) Patent No.: US 8,152,630 B2
(45) Date of Patent: Apr. 10, 2012

(54) GAMING SYSTEM AND METHOD HAVING BONUS EVENT AND BONUS EVENT AWARD IN ACCORDANCE WITH A CURRENT WAGER AND ONE OR MORE ACCUMULATED BONUS EVENT POINTS

(75) Inventor: Alexander Casey Naglestad Cohen, Reno, NV (US)

(73) Assignee: IGT, Reno, NV (US)

( * ) Notice: Subject to any disclaimer, the term of this patent is extended or adjusted under 35 U.S.C. 154(b) by 744 days.

(21) Appl. No.: 12/270,065

(22) Filed: Nov. 13, 2008

(65) Prior Publication Data

US 2010/0120499 A1 May 13, 2010

(51) Int. Cl.
*A63F 9/00* (2006.01)

(52) U.S. Cl. ..... 463/25; 463/16; 463/17; 463/18; 463/19; 463/20; 463/21; 463/23; 463/26; 463/27

(58) Field of Classification Search ..... 463/16–21, 463/23, 25–27
See application file for complete search history.

(56) References Cited

U.S. PATENT DOCUMENTS

| | | | | |
|---|---|---|---|---|
| 4,837,728 | A | | 6/1989 | Barrie et al. |
| 5,401,023 | A | | 3/1995 | Wood |
| 5,655,961 | A | | 8/1997 | Acres et al. |
| 5,702,304 | A | | 12/1997 | Acres et al. |
| 5,707,287 | A | | 1/1998 | Mccrea |
| 5,741,183 | A | | 4/1998 | Acres et al. |
| 5,752,882 | A | | 5/1998 | Acres et al. |
| 5,766,076 | A | | 6/1998 | Pease et al. |
| 5,779,549 | A | | 7/1998 | Walker et al. |
| 5,816,918 | A | * | 10/1998 | Kelly et al. ..... 463/16 |
| 5,820,459 | A | | 10/1998 | Acres et al. |
| 5,833,537 | A | | 11/1998 | Barrie |
| 5,833,540 | A | | 11/1998 | Miodunski et al. |
| 5,836,817 | A | | 11/1998 | Acres et al. |
| 5,855,515 | A | | 1/1999 | Pease et al. |

(Continued)

FOREIGN PATENT DOCUMENTS

EP 1 359 531 11/2003

(Continued)

OTHER PUBLICATIONS

Atronic Systems Progressive Products at G2E, published by Atronic in 2004, printed from ForRelease.com.

(Continued)

*Primary Examiner* — Dmitry Suhol
*Assistant Examiner* — David Duffy
(74) *Attorney, Agent, or Firm* — K&L Gates LLP

(57) ABSTRACT

In one embodiment, the gaming system and method disclosed herein maintains a plurality of different bonus event average expected payouts which are ranked. In one embodiment, if a bonus event triggering condition occurs, the gaming system determines one of the plurality of different bonus event average expected payouts to utilize for the triggered bonus event. In one such embodiment, the determined bonus event average expected payout is based on a player's current wager and a quantity of accumulated bonus event points or units. In this embodiment, the gaming system enables players to accumulate bonus event points based on one or more aspects of a player's previous gaming experiences during a designated period of time. The gaming system then displays a bonus event to the player and determines a bonus event award, wherein the determined bonus event award is in accordance with the determined bonus event average expected payout.

26 Claims, 11 Drawing Sheets

U.S. PATENT DOCUMENTS

| | | | | |
|---|---|---|---|---|
| 5,876,284 | A | 3/1999 | Acres et al. | |
| 5,885,158 | A | 3/1999 | Torango et al. | |
| 5,980,384 | A | 11/1999 | Barrie | |
| 6,007,426 | A | 12/1999 | Kelly et al. | |
| 6,015,344 | A * | 1/2000 | Kelly et al. | 463/16 |
| 6,110,041 | A | 8/2000 | Walker et al. | |
| 6,159,097 | A | 12/2000 | Gura | |
| 6,162,122 | A | 12/2000 | Acres et al. | |
| 6,186,894 | B1 | 2/2001 | Mayeroff | |
| 6,224,483 | B1 | 5/2001 | Mayeroff | |
| 6,224,486 | B1 | 5/2001 | Walker et al. | |
| 6,231,442 | B1 | 5/2001 | Mayeroff | |
| 6,231,445 | B1 | 5/2001 | Acres | |
| 6,241,608 | B1 | 6/2001 | Torango | |
| 6,244,958 | B1 | 6/2001 | Acres | |
| 6,254,483 | B1 | 7/2001 | Acres | |
| 6,257,981 | B1 | 7/2001 | Acres et al. | |
| 6,302,793 | B1 | 10/2001 | Fertitta, III et al. | |
| 6,312,333 | B1 | 11/2001 | Acres | |
| 6,312,334 | B1 | 11/2001 | Yoseloff et al. | |
| 6,319,125 | B1 | 11/2001 | Acres | |
| 6,328,649 | B1 | 12/2001 | Randall et al. | |
| 6,336,858 | B1 | 1/2002 | Yoseloff | |
| 6,358,147 | B1 | 3/2002 | Jaffe et al. | |
| 6,364,768 | B1 | 4/2002 | Acres et al. | |
| 6,371,852 | B1 | 4/2002 | Acres | |
| 6,375,567 | B1 | 4/2002 | Acres | |
| 6,375,569 | B1 | 4/2002 | Acres | |
| 6,386,975 | B1 | 5/2002 | Peterson | |
| 6,398,645 | B1 | 6/2002 | Yoseloff | |
| 6,425,828 | B2 | 7/2002 | Walker et al. | |
| 6,431,983 | B2 | 8/2002 | Acres | |
| 6,435,968 | B1 | 8/2002 | Torango | |
| 6,443,452 | B1 | 9/2002 | Brune | |
| RE37,885 | E | 10/2002 | Acres et al. | |
| 6,464,581 | B1 | 10/2002 | Yoseloff et al. | |
| 6,527,638 | B1 | 3/2003 | Walker et al. | |
| 6,565,434 | B1 | 5/2003 | Acres | |
| 6,565,436 | B1 | 5/2003 | Baerlocher | |
| 6,592,460 | B2 | 7/2003 | Torango | |
| 6,599,193 | B2 | 7/2003 | Baerlocher et al. | |
| 6,607,438 | B2 | 8/2003 | Baerlocher et al. | |
| 6,607,441 | B1 | 8/2003 | Acres | |
| 6,620,045 | B2 * | 9/2003 | Berman et al. | 463/25 |
| 6,632,139 | B1 | 10/2003 | Baerlocher | |
| 6,634,942 | B2 | 10/2003 | Walker et al. | |
| 6,634,943 | B1 | 10/2003 | Baerlocher | |
| 6,672,589 | B1 | 1/2004 | Lemke et al. | |
| 6,712,695 | B2 | 3/2004 | Mothwurf et al. | |
| 6,712,697 | B2 | 3/2004 | Acres | |
| 6,712,698 | B2 | 3/2004 | Paulsen et al. | |
| 6,726,563 | B1 | 4/2004 | Baerlocher et al. | |
| 6,726,565 | B2 | 4/2004 | Hughs-Baird | |
| 6,769,982 | B1 | 8/2004 | Brosnan | |
| 6,776,715 | B2 | 8/2004 | Price | |
| 6,789,801 | B2 | 9/2004 | Snow | |
| 6,796,899 | B2 | 9/2004 | Baerlocher | |
| 6,796,900 | B2 | 9/2004 | Baerlocher et al. | |
| 6,800,030 | B2 | 10/2004 | Acres | |
| 6,811,486 | B1 | 11/2004 | Luciano, Jr. | |
| 6,832,958 | B2 | 12/2004 | Acres et al. | |
| 6,843,724 | B2 | 1/2005 | Walker et al. | |
| 6,846,238 | B2 | 1/2005 | Wells | |
| 6,857,957 | B2 | 2/2005 | Marks et al. | |
| 6,875,108 | B1 | 4/2005 | Hughs-Baird | |
| 6,877,745 | B1 | 4/2005 | Walker et al. | |
| 6,884,167 | B2 | 4/2005 | Walker et al. | |
| 6,887,154 | B1 | 5/2005 | Luciano, Jr. et al. | |
| 6,908,387 | B2 | 6/2005 | Hedrick et al. | |
| 6,910,962 | B2 | 6/2005 | Marks et al. | |
| 6,910,964 | B2 | 6/2005 | Acres | |
| 6,929,952 | B2 | 8/2005 | Baerlocher | |
| 6,935,952 | B2 | 8/2005 | Walker et al. | |
| 6,939,234 | B2 | 9/2005 | Beatty | |
| RE38,812 | E | 10/2005 | Acres et al. | |
| 6,955,600 | B2 | 10/2005 | Glavich et al. | |
| 6,958,013 | B2 | 10/2005 | Miereau et al. | |
| 6,991,544 | B2 | 1/2006 | Soltys et al. | |
| 6,997,803 | B2 | 2/2006 | Lemay et al. | |
| 7,018,291 | B1 | 3/2006 | Lemke et al. | |
| 7,029,395 | B1 | 4/2006 | Baerlocher | |
| 7,033,270 | B2 | 4/2006 | Baerlocher et al. | |
| 7,056,215 | B1 | 6/2006 | Olive | |
| 7,063,617 | B2 | 6/2006 | Brosnan et al. | |
| 7,070,501 | B2 | 7/2006 | Cormack et al. | |
| 7,077,746 | B2 | 7/2006 | Torango | |
| 7,108,603 | B2 | 9/2006 | Olive | |
| 7,112,138 | B2 | 9/2006 | Hedrick et al. | |
| 7,115,033 | B1 | 10/2006 | Timperley | |
| 7,172,508 | B2 | 2/2007 | Simon et al. | |
| 7,192,352 | B2 | 3/2007 | Walker et al. | |
| 7,198,571 | B2 | 4/2007 | Lemay et al. | |
| 7,223,172 | B2 | 5/2007 | Baerlocher et al. | |
| 7,235,011 | B2 | 6/2007 | Randall et al. | |
| 7,238,109 | B2 | 7/2007 | Mcgahn et al. | |
| 7,238,110 | B2 | 7/2007 | Glavich et al. | |
| 7,255,645 | B2 | 8/2007 | Steil et al. | |
| 7,291,068 | B2 | 11/2007 | Bryant et al. | |
| 7,300,351 | B2 | 11/2007 | Thomas | |
| 7,303,470 | B2 | 12/2007 | George et al. | |
| 7,311,605 | B2 | 12/2007 | Moser | |
| 7,318,774 | B2 | 1/2008 | Bryant et al. | |
| 7,318,775 | B2 | 1/2008 | Brosnan et al. | |
| 7,326,115 | B2 | 2/2008 | Baerlocher | |
| 7,328,838 | B2 | 2/2008 | Brosnan et al. | |
| 7,329,179 | B2 | 2/2008 | Baerlocher | |
| 7,329,186 | B2 * | 2/2008 | Griswold et al. | 463/29 |
| 7,351,146 | B2 | 4/2008 | Kaminkow | |
| 7,351,149 | B1 | 4/2008 | Simon et al. | |
| 7,357,713 | B2 | 4/2008 | Marks et al. | |
| 7,357,716 | B2 | 4/2008 | Marks et al. | |
| 7,371,171 | B1 | 5/2008 | Englman et al. | |
| 7,374,486 | B2 | 5/2008 | Baerlocher | |
| 7,384,336 | B2 | 6/2008 | Torango | |
| 7,384,337 | B2 | 6/2008 | Thomas | |
| 7,390,255 | B2 | 6/2008 | Walker et al. | |
| 7,393,280 | B2 | 7/2008 | Cannon | |
| 7,402,101 | B2 | 7/2008 | Casey | |
| 7,404,765 | B2 | 7/2008 | Soltys et al. | |
| 7,419,430 | B1 | 9/2008 | Joshi et al. | |
| 7,427,233 | B2 | 9/2008 | Walker et al. | |
| 7,427,234 | B2 | 9/2008 | Soltys et al. | |
| 7,438,642 | B2 | 10/2008 | Walker et al. | |
| 7,455,585 | B2 * | 11/2008 | Englman | 463/16 |
| 7,455,587 | B2 | 11/2008 | Olive et al. | |
| 7,465,227 | B2 | 12/2008 | Baerlocher | |
| 7,470,184 | B2 | 12/2008 | Baerlocher et al. | |
| 7,470,185 | B2 | 12/2008 | Baerlocher | |
| 2001/0036855 | A1 | 11/2001 | DeFrees-parrott et al. | |
| 2001/0036864 | A1 | 11/2001 | Melas | |
| 2001/0055990 | A1 | 12/2001 | Acres | |
| 2002/0142825 | A1 | 10/2002 | Lark et al. | |
| 2002/0142846 | A1 | 10/2002 | Paulsen | |
| 2002/0147049 | A1 | 10/2002 | Carter, Sr. | |
| 2002/0198044 | A1 | 12/2002 | Walker et al. | |
| 2003/0032474 | A1 | 2/2003 | Kaminkow | |
| 2003/0036425 | A1 | 2/2003 | Kaminkow et al. | |
| 2003/0060279 | A1 | 3/2003 | Torango | |
| 2003/0064793 | A1 | 4/2003 | Baerlocher et al. | |
| 2003/0069056 | A1 | 4/2003 | Cormack et al. | |
| 2003/0078101 | A1 | 4/2003 | Schneider et al. | |
| 2003/0166410 | A1 | 9/2003 | Olive | |
| 2003/0181237 | A1 | 9/2003 | Olive | |
| 2003/0190958 | A1 | 10/2003 | Paulsen | |
| 2003/0216166 | A1 | 11/2003 | Baerlocher et al. | |
| 2003/0216170 | A1 | 11/2003 | Walker et al. | |
| 2003/0222402 | A1 | 12/2003 | Olive | |
| 2003/0228904 | A1 | 12/2003 | Acres et al. | |
| 2004/0036212 | A1 | 2/2004 | Walker et al. | |
| 2004/0048644 | A1 | 3/2004 | Gerrard et al. | |
| 2004/0063492 | A1 | 4/2004 | Baerlocher et al. | |
| 2004/0067790 | A1 | 4/2004 | Peterson et al. | |
| 2004/0082373 | A1 | 4/2004 | Cole et al. | |
| 2004/0087357 | A1 | 5/2004 | Johnson | |
| 2004/0087370 | A1 | 5/2004 | Tarantino | |
| 2004/0092303 | A1 | 5/2004 | George et al. | |
| 2004/0092304 | A1 | 5/2004 | George et al. | |

2004/0106448 A1 6/2004 Gauselmann
2004/0110555 A1* 6/2004 Devaull et al. ..... 463/20
2004/0111358 A1 6/2004 Lange et al.
2004/0113360 A1 6/2004 George et al.
2004/0171416 A1 9/2004 Baerlocher et al.
2004/0192434 A1 9/2004 Walker et al.
2004/0198487 A1 10/2004 Schneider
2004/0204214 A1 10/2004 Tucci
2004/0204218 A1 10/2004 Hughs-Baird
2004/0229683 A1 11/2004 Mothwurf et al.
2004/0248634 A1 12/2004 Herrmann et al.
2004/0266516 A1 12/2004 Thomas
2004/0266517 A1 12/2004 Bleich et al.
2005/0003886 A1 1/2005 Englman et al.
2005/0003890 A1 1/2005 Hedrick et al.
2005/0014554 A1 1/2005 Walker et al.
2005/0014558 A1 1/2005 Estey
2005/0026676 A1 2/2005 Olive
2005/0027381 A1 2/2005 George et al.
2005/0030403 A1 2/2005 Yaung et al.
2005/0032573 A1 2/2005 Acres et al.
2005/0033461 A1 2/2005 Gerrard et al.
2005/0037832 A1 2/2005 Cannon
2005/0037837 A1 2/2005 Rowe
2005/0043082 A1 2/2005 Peterson et al.
2005/0049043 A1 3/2005 Crivelli et al.
2005/0054417 A1 3/2005 Parrott et al.
2005/0054429 A1 3/2005 Baerlocher et al.
2005/0054434 A1 3/2005 Baerlocher et al.
2005/0054439 A1 3/2005 Rowe et al.
2005/0059467 A1 3/2005 Saffari et al.
2005/0060050 A1 3/2005 Baerlocher
2005/0070356 A1 3/2005 Mothwurf et al.
2005/0075163 A1 4/2005 Cuddy et al.
2005/0075165 A1 4/2005 George et al.
2005/0096121 A1 5/2005 Gilliland et al.
2005/0096123 A1 5/2005 Cregan et al.
2005/0101374 A1 5/2005 Acres
2005/0101383 A1 5/2005 Wells
2005/0119047 A1 6/2005 Olive
2005/0127606 A1 6/2005 Snow et al.
2005/0143168 A1 6/2005 Torango
2005/0153768 A1 7/2005 Paulsen
2005/0153773 A1 7/2005 Nguyen et al.
2005/0159200 A1 7/2005 Nicely et al.
2005/0176488 A1 8/2005 Olive
2005/0176499 A1 8/2005 Stronach
2005/0181875 A1 8/2005 Hoehne et al.
2005/0187014 A1 8/2005 Saffari et al.
2005/0187022 A1 8/2005 Walker et al.
2005/0209004 A1 9/2005 Torango
2005/0227756 A1 10/2005 Kane et al.
2005/0227757 A1 10/2005 Simon
2005/0239542 A1 10/2005 Olsen
2005/0239546 A1 10/2005 Hedrick et al.
2005/0255911 A1 11/2005 Nguyen et al.
2005/0255922 A1 11/2005 Nguyen et al.
2005/0261055 A1 11/2005 Casey et al.
2005/0261059 A1 11/2005 Nguyen et al.
2005/0261060 A1 11/2005 Nguyen et al.
2005/0261061 A1 11/2005 Nguyen et al.
2005/0282609 A1 12/2005 Olive
2005/0282625 A1 12/2005 Nicely
2006/0003829 A1 1/2006 Thomas
2006/0003835 A1 1/2006 Olive
2006/0009283 A1 1/2006 Englman et al.
2006/0014579 A1 1/2006 Kane et al.
2006/0019750 A1 1/2006 Beatty
2006/0025195 A1 2/2006 Pennington et al.
2006/0025197 A1 2/2006 Kane et al.
2006/0030400 A1 2/2006 Mathis
2006/0035696 A1 2/2006 Walker et al.
2006/0035706 A1 2/2006 Thomas et al.
2006/0040723 A1 2/2006 Baerlocher et al.
2006/0040725 A1 2/2006 Walker et al.
2006/0040732 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0052160 A1 3/2006 Saffari et al.
2006/0052161 A1 3/2006 Soukup et al.
2006/0052162 A1 3/2006 Soukup et al.
2006/0058089 A1 3/2006 White et al.
2006/0068872 A1 3/2006 Walker et al.
2006/0068873 A1 3/2006 Gomez
2006/0068876 A1 3/2006 Kane et al.
2006/0068913 A1 3/2006 Walker et al.
2006/0073869 A1 4/2006 Lemay et al.
2006/0073870 A1 4/2006 Cannon
2006/0073887 A1 4/2006 Nguyen et al.
2006/0073888 A1 4/2006 Nguyen et al.
2006/0073897 A1 4/2006 Englman et al.
2006/0079309 A1 4/2006 Walker et al.
2006/0079317 A1 4/2006 Flemming et al.
2006/0079318 A1 4/2006 Aoki et al.
2006/0082056 A1 4/2006 Kane et al.
2006/0094495 A1 5/2006 Gelber et al.
2006/0100009 A1 5/2006 Walker et al.
2006/0100019 A1 5/2006 Hornik et al.
2006/0111164 A1 5/2006 Hornik et al.
2006/0111169 A1 5/2006 Hornik et al.
2006/0111172 A1 5/2006 Walker et al.
2006/0111175 A1 5/2006 Walker et al.
2006/0121969 A1 6/2006 Marks et al.
2006/0121972 A1 6/2006 Walker et al.
2006/0121978 A1 6/2006 Hornik et al.
2006/0128457 A1 6/2006 Cannon
2006/0128460 A1 6/2006 Muir et al.
2006/0135243 A1 6/2006 Englman et al.
2006/0142079 A1 6/2006 Ikehara et al.
2006/0142086 A1 6/2006 Blackburn et al.
2006/0148549 A1 7/2006 Walker et al.
2006/0148558 A1 7/2006 Olive
2006/0149561 A1 7/2006 Govender
2006/0160605 A1 7/2006 Hornik et al.
2006/0160614 A1 7/2006 Walker et al.
2006/0160625 A1 7/2006 Englman et al.
2006/0166730 A1 7/2006 Olive
2006/0166735 A1 7/2006 Steil et al.
2006/0172803 A1 8/2006 Hardy et al.
2006/0172804 A1 8/2006 Acres et al.
2006/0178196 A1 8/2006 Thomas
2006/0178199 A1 8/2006 Thomas
2006/0178202 A1 8/2006 Hughes et al.
2006/0178203 A1 8/2006 Hughes et al.
2006/0183529 A1 8/2006 Acres et al.
2006/0189371 A1 8/2006 Walker et al.
2006/0189376 A1 8/2006 Hornik et al.
2006/0189377 A1 8/2006 Gomez et al.
2006/0189379 A1 8/2006 Pacey
2006/0194633 A1 8/2006 Paulsen
2006/0205468 A1 9/2006 Saffari et al.
2006/0205482 A1 9/2006 Crivelli
2006/0211465 A1 9/2006 Moshal
2006/0211466 A1 9/2006 Ward et al.
2006/0211472 A1 9/2006 Walker et al.
2006/0211473 A1 9/2006 Walker et al.
2006/0211474 A1 9/2006 Walker et al.
2006/0211478 A1 9/2006 Walker et al.
2006/0211484 A1 9/2006 Hornik et al.
2006/0217187 A1 9/2006 Walker et al.
2006/0217188 A1 9/2006 Walker et al.
2006/0217189 A1 9/2006 Walker et al.
2006/0223606 A1 10/2006 Walker et al.
2006/0223607 A1 10/2006 Walker et al.
2006/0223608 A1 10/2006 Walker et al.
2006/0223614 A1 10/2006 Olive
2006/0223615 A1 10/2006 Englman
2006/0229121 A1 10/2006 Rasmussen et al.
2006/0240890 A1 10/2006 Walker et al.
2006/0247026 A1 11/2006 Walker et al.
2006/0247029 A1 11/2006 Walker et al.
2006/0252482 A1 11/2006 Walker et al.
2006/0252529 A1 11/2006 Hedrick et al.
2006/0264257 A1 11/2006 Jaffe et al.
2006/0270477 A1 11/2006 Snow
2006/0277100 A1 12/2006 Parham
2006/0279044 A1 12/2006 Pacey 2006/0281528 A1 12/2006 Hall et al.
2006/0281541 A1 12/2006 Nguyen et al.
2006/0284378 A1 12/2006 Snow et al.
2006/0287034 A1 12/2006 Englman et al.
2006/0287035 A1 12/2006 Walker et al.
2006/0287046 A1 12/2006 Walker et al.
2006/0287054 A1 12/2006 Walker et al.
2006/0287091 A1 12/2006 Walker et al.
2006/0287092 A1 12/2006 Walker et al.
2006/0287093 A1 12/2006 Walker et al.
2006/0287094 A1 12/2006 Mahaffey et al.
2006/0287095 A1 12/2006 Mattice et al.
2007/0026924 A1 2/2007 Taylor
2007/0026941 A1 2/2007 Block et al.
2007/0032301 A1 2/2007 Acres et al.
2007/0045958 A1 3/2007 Rader et al.
2007/0054723 A1 3/2007 Mattice et al.
2007/0054726 A1 3/2007 Muir et al.
2007/0054729 A1 3/2007 Hornik et al.
2007/0054732 A1 3/2007 Baerlocher
2007/0054733 A1 3/2007 Baerlocher
2007/0060237 A1 3/2007 Rowe et al.
2007/0060246 A1 3/2007 Baerlocher et al.
2007/0060271 A1 3/2007 Cregan et al.
2007/0060297 A1 3/2007 Hein et al.
2007/0060314 A1 3/2007 Baerlocher et al.
2007/0060319 A1 3/2007 Block et al.
2007/0060320 A1 3/2007 Kelly et al.
2007/0060321 A1 3/2007 Vasquez et al.
2007/0060326 A1 3/2007 Juds et al.
2007/0060333 A1 3/2007 Englman et al.
2007/0060365 A1 3/2007 Tien et al.
2007/0077978 A1 4/2007 Walker et al.
2007/0077979 A1 4/2007 Cohn et al.
2007/0077981 A1 4/2007 Hungate et al.
2007/0077985 A1 4/2007 Walker et al.
2007/0087832 A1 4/2007 Abbott et al.
2007/0105619 A1 5/2007 Kniesteadt et al.
2007/0105620 A1 5/2007 Cuddy et al.
2007/0106553 A1 5/2007 Jordan et al.
2007/0111778 A1 5/2007 Walker et al.
2007/0111783 A1 5/2007 Cuddy et al.
2007/0111785 A1 5/2007 Olive
2007/0117607 A1 5/2007 Olive
2007/0117608 A1 5/2007 Roper et al.
2007/0117616 A1 5/2007 Bartholomew
2007/0117618 A1 5/2007 Walker et al.
2007/0117619 A1 5/2007 Walker et al.
2007/0117621 A1 5/2007 Walker et al.
2007/0117641 A1 5/2007 Walker et al.
2007/0123347 A1 5/2007 Walker et al.
2007/0129128 A1 6/2007 McClintic
2007/0129131 A1 6/2007 Kaminkow et al.
2007/0135214 A1 6/2007 Walker et al.
2007/0135215 A1 6/2007 Walker et al.
2007/0136817 A1 6/2007 Nguyen
2007/0155480 A1 7/2007 Brosnan et al.
2007/0155485 A1 7/2007 Cuddy et al.
2007/0155490 A1 7/2007 Phillips et al.
2007/0155512 A1 7/2007 Wells et al.
2007/0167210 A1 7/2007 Kelly et al.
2007/0167226 A1 7/2007 Kelly et al.
2007/0167229 A1 7/2007 Lemay et al.
2007/0173311 A1 7/2007 Morrow et al.
2007/0178970 A1 8/2007 Lemay et al.
2007/0179839 A1* 8/2007 Neemann ..... 705/14
2007/0184887 A1 8/2007 Cannon
2007/0184891 A1 8/2007 Thomas
2007/0191087 A1 8/2007 Thomas et al.
2007/0191088 A1 8/2007 Breckner et al.
2007/0191107 A1 8/2007 Walker et al.
2007/0191109 A1 8/2007 Crowder et al.
2007/0202941 A1 8/2007 Miltenberger et al.
2007/0213114 A1 9/2007 Caspers et al.
2007/0213119 A1 9/2007 Baerlocher et al.
2007/0218975 A1 9/2007 Iddings et al.
2007/0218982 A1 9/2007 Baerlocher
2007/0218983 A1 9/2007 Lombardo
2007/0243925 A1 10/2007 Lemay et al.
2007/0243928 A1 10/2007 Iddings
2007/0243934 A1 10/2007 Little et al.
2007/0254733 A1 11/2007 Hornik et al.
2007/0254734 A1 11/2007 Gilmore et al.
2007/0257429 A1 11/2007 Kane et al.
2007/0259709 A1 11/2007 Kelly et al.
2007/0259711 A1 11/2007 Thomas
2007/0259713 A1 11/2007 Fiden et al.
2007/0270208 A1 11/2007 Caspers et al.
2007/0270213 A1 11/2007 Nguyen et al.
2007/0293293 A1 12/2007 Baerlocher et al.
2007/0298857 A1 12/2007 Schlottmann et al.
2007/0298873 A1 12/2007 Nguyen et al.
2007/0298874 A1 12/2007 Baerlocher et al.
2007/0298875 A1 12/2007 Baerlocher et al.
2008/0004104 A1 1/2008 Durham et al.
2008/0004106 A1 1/2008 Bryant et al.
2008/0009333 A1 1/2008 Walker et al.
2008/0009334 A1 1/2008 Walker et al.
2008/0009335 A1 1/2008 Walker et al.
2008/0009344 A1 1/2008 Graham et al.
2008/0015012 A1 1/2008 Englman et al.
2008/0020823 A1 1/2008 Cuddy et al.
2008/0020824 A1 1/2008 Cuddy et al.
2008/0020825 A1 1/2008 Cuddy et al.
2008/0020831 A1 1/2008 Ikehara et al.
2008/0020832 A1 1/2008 Iddings et al.
2008/0020833 A1 1/2008 Baerlocher et al.
2008/0020834 A1 1/2008 Breckner et al.
2008/0020846 A1 1/2008 Vasquez et al.
2008/0020847 A1 1/2008 Kniesteadt et al.
2008/0020848 A1 1/2008 Muir et al.
2008/0026827 A1 1/2008 Skotarczak et al.
2008/0026844 A1 1/2008 Wells
2008/0032764 A1 2/2008 Cannon
2008/0032787 A1 2/2008 Low et al.
2008/0039191 A1 2/2008 Cuddy
2008/0045341 A1 2/2008 Englman
2008/0045344 A1 2/2008 Schlottmann et al.
2008/0051193 A1 2/2008 Kaminkow et al.
2008/0058098 A1 3/2008 Seelig et al.
2008/0064478 A1 3/2008 Roukis et al.
2008/0064480 A1 3/2008 Randall
2008/0064496 A1 3/2008 Olive
2008/0064502 A1 3/2008 Schlottmann et al.
2008/0070652 A1 3/2008 Nguyen et al.
2008/0070676 A1 3/2008 Baerlocher et al.
2008/0070677 A1 3/2008 Baerlocher et al.
2008/0070678 A1 3/2008 Baerlocher et al.
2008/0070680 A1 3/2008 Baerlocher et al.
2008/0070693 A1 3/2008 Schlottmann et al.
2008/0070695 A1 3/2008 Baerlocher et al.
2008/0076496 A1 3/2008 Baerlocher et al.
2008/0076503 A1 3/2008 Mattice et al.
2008/0076514 A1 3/2008 Baerlocher et al.
2008/0076515 A1 3/2008 Baerlocher et al.
2008/0076517 A1 3/2008 Baerlocher et al.
2008/0076520 A1 3/2008 Chan et al.
2008/0076527 A1 3/2008 Low et al.
2008/0076531 A1 3/2008 Baerlocher et al.
2008/0076532 A1 3/2008 Graham et al.
2008/0076534 A1 3/2008 Iddings et al.
2008/0076540 A1 3/2008 Aida
2008/0076542 A1 3/2008 Iddings et al.
2008/0076548 A1 3/2008 Paulsen
2008/0076552 A1 3/2008 Baerlocher et al.
2008/0076571 A1 3/2008 Frerking
2008/0076576 A1 3/2008 Graham et al.
2008/0081690 A1 4/2008 Baerlocher et al.
2008/0081691 A1 4/2008 Baerlocher et al.
2008/0085771 A1 4/2008 Iddings et al.
2008/0085772 A1 4/2008 Iddings et al.
2008/0090648 A1 4/2008 Brosnan et al.
2008/0090650 A1 4/2008 Tarantino
2008/0090651 A1 4/2008 Baerlocher
2008/0090655 A1 4/2008 Marks et al.
2008/0096645 A1 4/2008 Frerking et al.
2008/0096650 A1 4/2008 Baerlocher
2008/0102920 A1 5/2008 Baerlocher 2008/0102931 A1 5/2008 Marks et al.
2008/0102934 A1 5/2008 Tan
2008/0102935 A1 5/2008 Finnimore
2008/0108404 A1 5/2008 Iddings et al.
2008/0108406 A1 5/2008 Oberberger
2008/0108409 A1 5/2008 Cole et al.
2008/0108410 A1 5/2008 Baerlocher
2008/0108423 A1 5/2008 Benbrahim
2008/0108425 A1 5/2008 Oberberger
2008/0108426 A1 5/2008 Nguyen et al.
2008/0108430 A1 5/2008 Evans
2008/0108431 A1 5/2008 Cuddy et al.
2008/0113714 A1 5/2008 Vallejo
2008/0113759 A1 5/2008 Baerlocher
2008/0113763 A1 5/2008 Michaelson et al.
2008/0113770 A1 5/2008 Gelber et al.
2008/0113771 A1 5/2008 Baerlocher et al.
2008/0113779 A1 5/2008 Cregan
2008/0113780 A1 5/2008 Vallejo
2008/0113814 A1 5/2008 Osburn
2008/0113816 A1 5/2008 Mahaffey et al.
2008/0119283 A1 5/2008 Baerlocher
2008/0120221 A1 5/2008 Toneguzzo
2008/0125211 A1 5/2008 Plowman
2008/0132320 A1 6/2008 Rodgers
2008/0132329 A1 6/2008 Jorasch et al.
2008/0139274 A1 6/2008 Baerlocher
2008/0139283 A1 6/2008 Kelly et al.
2008/0139290 A1 6/2008 Kniesteadt et al.
2008/0139305 A1 6/2008 Vallejo et al.
2008/0146325 A1 6/2008 Walker et al.
2008/0146344 A1 6/2008 Rowe et al.
2008/0149705 A1 6/2008 Giobbit et al.
2008/0153563 A1 6/2008 Englman
2008/0153564 A1 6/2008 Baerlocher et al.
2008/0167105 A1 7/2008 Kaminkow
2008/0167118 A1 7/2008 Kroeckel et al.
2008/0167130 A1 7/2008 Kroeckel et al.
2008/0176624 A1 7/2008 Phillips et al.
2008/0176645 A1 7/2008 Griswold et al.
2008/0176650 A1 7/2008 Wolf et al.
2008/0176660 A1 7/2008 Kelly et al.
2008/0182650 A1 7/2008 Randall et al.
2008/0182655 A1 7/2008 Dewaal et al.
2008/0194316 A1 8/2008 Baerlocher
2008/0200237 A1 8/2008 Cuddy et al.
2008/0200241 A1 8/2008 Davies
2008/0200244 A1 8/2008 Rowe et al.
2008/0207298 A1 8/2008 Marks et al.
2008/0214280 A1 9/2008 Baerlocher
2008/0214288 A1 9/2008 Toneguzzo
2008/0214293 A1 9/2008 Kelly et al.
2008/0214300 A1 9/2008 Williams et al.
2008/0220852 A1 9/2008 Olive
2008/0220857 A1 9/2008 Kelly et al.
2008/0227523 A1 9/2008 Vallejo et al.
2008/0227524 A1 9/2008 Kelly et al.
2008/0227530 A1 9/2008 LeMay et al.
2008/0227538 A1 9/2008 Kelly et al.
2008/0227551 A1 9/2008 Kelly et al.
2008/0234047 A1 9/2008 Nguyen
2008/0242399 A1 10/2008 Toneguzzo
2008/0248862 A1 10/2008 Joshi et al.
2008/0248867 A1 10/2008 Englman et al.
2008/0254883 A1 10/2008 Patel et al.
2008/0254885 A1 10/2008 Kelly
2008/0254886 A1 10/2008 Kelly
2008/0254893 A1 10/2008 Patel et al.
2008/0261682 A1 10/2008 Phillips et al.
2008/0268937 A1 10/2008 Bryant et al.
2008/0268945 A1 10/2008 Bryant et al.
2008/0268946 A1 10/2008 Roemer
2008/0274783 A1 11/2008 Walker et al.
2008/0274790 A1 11/2008 Cannon
2008/0274796 A1 11/2008 Lube
2008/0274800 A1 11/2008 Bryant et al.
2008/0274801 A1 11/2008 Bryant et al.
2008/0287184 A1 11/2008 Boesen
2008/0287186 A1 11/2008 Sakuma
2008/0300049 A1 12/2008 Anderson et al.
2008/0305864 A1 12/2008 Kelly et al.
2008/0305865 A1 12/2008 Kelly et al.
2008/0311979 A1 12/2008 Walker et al.
2008/0318655 A1 12/2008 Davies
2008/0318668 A1 12/2008 Ching et al.
2008/0318686 A1 12/2008 Crowder et al.
2009/0005152 A9 1/2009 Kelly et al.
2009/0005158 A9 1/2009 Kelly et al.
2009/0005165 A1 1/2009 Arezina et al.
2009/0005170 A9 1/2009 Kelly et al.
2009/0011822 A1 1/2009 Englman et al.
2009/0011823 A1 1/2009 Englman et al.
2009/0011824 A1 1/2009 Englman et al.
2009/0011827 A1 1/2009 Englman et al.
2009/0029765 A1 1/2009 Acres
2009/0048010 A1 2/2009 Kroeckel et al.
2009/0054134 A1* 2/2009 Jackson ..... 463/25

FOREIGN PATENT DOCUMENTS

WO WO 97/39811 10/1997
WO WO 2004/037363 5/2004
WO WO 2004/066061 8/2004
WO WO 2005/029287 3/2005
WO WO 2005/099425 10/2005
WO WO 2006/004831 1/2006
WO WO 2006/014990 2/2006
WO WO 2006/039349 4/2006
WO WO 2006/044252 4/2006
WO WO 2006/130597 12/2006
WO WO 2006/130611 12/2006
WO WO 2007/024584 3/2007
WO WO 2007/028108 3/2007
WO WO 2007/030733 3/2007
WO WO 2007/078533 7/2007
WO WO 2007/085054 8/2007
WO WO 2007/087297 8/2007
WO WO 2007/103054 9/2007
WO WO 2007/117502 10/2007
WO WO 2007/123858 11/2007
WO WO 2007/124047 11/2007
WO WO 2007/127259 11/2007
WO WO 2007/130464 11/2007
WO WO 2007/139774 12/2007
WO WO 2007/149238 12/2007
WO WO 2008/021449 2/2008
WO WO 2008/024349 2/2008
WO WO 2008/030955 3/2008
WO WO 2008/033877 3/2008
WO WO 2008/039403 4/2008
WO WO 2008/039848 4/2008
WO WO 2008/045398 4/2008
WO WO 2008/048634 4/2008
WO WO 2008/051796 5/2008
WO WO 2008/054723 5/2008
WO WO 2008/057356 5/2008
WO WO 2008/060426 5/2008
WO WO 2008/060442 5/2008
WO WO 2008/060978 5/2008
WO WO 2008/063297 5/2008
WO WO 2008/063349 5/2008
WO WO 2008/063393 5/2008
WO WO 2008/063394 5/2008
WO WO 2008/063395 5/2008
WO WO 2008/103246 8/2008
WO WO 2008/103578 8/2008
WO WO 2008/133849 11/2008

OTHER PUBLICATIONS

Bally Live-Server Based Gaming brochure, written by Bally Gaming Systems, published in 2006.

Cash Express Advertisements, written by Aristocrat, published in 2002.

Fast Buck Systems Manual, written by International Game Technology, available to Mirage shift supervisors at least as early as May 30, 1990.

Floor of the Future Article, written by Strictly Slots, published in Feb. 2008.

Hot Shot Progressive Article, written by Strictly Slots, published in Feb. 2006.
Jackpot Carnival Hyperlink Advertisement, written by Aristocrat, published prior to 2002.
Jackpot Party Brochure and Articles written by WMS Gaming, Inc, published in 1998.
PEM—Precision Electronic Meter, written by GRIPS Electronic GmbH, printed from website reported as archived on Feb. 20, 1997 (available at http://web.archive.org/web/19970220165753/www.grips.com/pem.htm).
Player Tracking on Slots, written by GRIPS Electronic GmbH, printed from website reported as archived on Feb. 20, 1997 (available at http://web.archive.org/web/19970220165921/www.grips.com/playtrac.htm).
ProLINK Progressive Controller User/Reference Manual, written by Casino Data Systems, published in Apr. 1997.
Star Wars Article, written by Indian Gaming, published in Nov. 2007.
Wide Area Progressive Link System, written by GRIPS Electronic GmbH, printed from website reported as archived on Feb. 20, 1997 (available at http://web.archive.org/web/19970220165457/www.grips.com/wap.htm).
Zorro Advertisement, written by Aristocrat, published in 2004.

* cited by examiner

FIG. 4A

| POINTS REQUIRED TO PARTICIPATE IN BONUS EVENT | CURRENT WAGER | | |
|---|---|---|---|
| | BET 50 | BET 100 | BET 150 |
| 11 FREE SPINS | 0 | 0 | 0 |
| 12 FREE SPINS | 100 | 200 | 300 |
| 13 FREE SPINS | 200 | 400 | 600 |
| 14 FREE SPINS | 300 | 600 | 900 |

FIG. 4B

| BONUS EVENT AVERAGE EXPECTED PAYOUT | CURRENT WAGER | | |
|---|---|---|---|
| | BET 50 | BET 100 | BET 150 |
| 12 FREE SPINS | $10.00 | $20.00 | $30.00 |
| 13 FREE SPINS | $10.83 | $21.67 | $32.50 |

FIG. 6

| Free Bonus Event Spin | Free Bonus Event Spin Award Amount |
|---|---|
| 1 | $5 |
| 2 | $0 |
| 3 | $1 |
| 4 | $0 |
| 5 | $0 |
| 6 | $0 |
| 7 | $2 |
| 8 | $4 |
| 9 | $1 |
| 10 | $1 |
| 11 | $2 |
| 12 | $0 |

Total Award Amount: $16.00

GAMING SYSTEM AND METHOD HAVING BONUS EVENT AND BONUS EVENT AWARD IN ACCORDANCE WITH A CURRENT WAGER AND ONE OR MORE ACCUMULATED BONUS EVENT POINTS

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and based on the amount of the wager (e.g., the higher the wager, the higher the award). Symbols or symbol combinations which are less likely to occur usually provide higher awards. In such known gaming machines, the amount of the wager made on the base game by the player may vary. For instance, the gaming machine may allow the player to wager a minimum number of credits, such as one credit (e.g., one cent, nickel, dime, quarter or dollar) up to a maximum number of credits, such as five credits. This wager may be made by the player a single time or multiple times in a single play of a primary game. For instance, a slot game may have one or more paylines and the slot game may allow the player to make a wager on each payline in a single play of the primary game. Slot games with 1, 3, 5, 9, 15 and 25 lines are widely commercially available. Thus, it is known that a gaming machine, such as a slot game, may enable players to make wagers of substantially different amounts on each play of the primary or base game ranging, for example, from one credit up to 125 credits (e.g., five credits on each of 25 separate paylines).

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine generally indicates this to the player through one or more visual and/or audio output devices, such as the reels, lights, speakers, video screens, etc. Part of the enjoyment and excitement of playing certain gaming machines is the occurrence of the secondary or bonus game (even before the player knows how much the bonus award will be).

There is a continuing need to provide new and different gaming machines and gaming systems as well as new and different ways to provide awards to players including bonus awards and progressive awards.

SUMMARY

In various embodiments, the gaming system and method disclosed herein maintains a plurality of different bonus event configurations, wherein each bonus event configuration has a bonus event average expected payout or bonus event average expected value. In one embodiment, these bonus event configurations are ranked, or otherwise organized into a plurality of tiers. If a bonus event triggering condition occurs, the gaming system selects one of these ranked bonus event configurations to utilize for the triggered bonus event. In one such embodiment, the gaming system selects a bonus event configuration based on a player's current wager and a quantity of accumulated bonus event points or units. In this embodiment, the gaming system accumulates bonus event points based on one or more aspects of a player's previous gaming experiences or gaming activity, such as the player's previous wagers or coin-in during a designated period of time. After selecting a bonus event configuration for the triggered bonus event, the gaming system displays a bonus event to the player and determines a bonus event award. In one embodiment, the determined bonus event award is in accordance with the bonus event average expected payout associated with the selected bonus event configuration. Accordingly, the gaming system and method disclosed herein provides a bonus event with a bonus event average expected payout (and thus provides a player with a bonus event award) that is based on a player's current wager and the player's previous gaming experiences or gaming activity during a designated period of time, such as between bonus event triggering conditions.

In one embodiment, the gaming system includes a plurality of different bonus event configurations, wherein each bonus event configuration is associated with a bonus event average expected payout. In one such embodiment, each bonus event configuration is ranked, or otherwise suitably tiered, based on the associated bonus event average expected payout for that bonus event configuration relative to the average expected payout of other bonus event configurations. For example, a gaming system includes four different bonus event configurations which are displayed to the player as four different quantities of free spins. In this example, a first tiered bonus event configuration includes eleven free spins, a second tiered bonus event configuration includes twelve free spins, a third tiered bonus event configuration includes thirteen free spins, and a fourth tiered bonus event configuration includes fourteen free spins.

In one embodiment, for one or more plays of the primary game, the gaming system accumulates a quantity of bonus event points or units. In one such embodiment, the gaming system accumulates bonus event points based on the player's current wager. In another such embodiment, the gaming system accumulates bonus event points based on the player's wagering history. In other words, the gaming system tracks the player's wagers over a designated period of time, such as between bonus event triggering conditions, and when the player's tracked wagers reach a designated threshold, the gaming system accumulates a designated quantity of bonus event points.

If a bonus event triggering condition occurs, the gaming system selects one of the maintained plurality of different bonus event configurations to utilize for the triggered bonus event. In one embodiment, a bonus event configuration is selected from the maintained plurality of different bonus event configurations based on the player's current wager and a quantity of accumulated bonus event points. For example, the gaming system selects a first bonus event configuration which has a first bonus event average expected payout for a first player who places a first wager with a first quantity of accumulated bonus event points. In this example, the gaming system selects a second, different bonus event configuration which has a second, higher bonus event average expected payout for a second player who places the first wager with a second, larger quantity of accumulated bonus event points. In another example, the gaming system selects a second, different bonus event configuration which has a second, higher bonus event average expected payout for a second player who places a second, higher wager with the first quantity of accumulated bonus event points.

After selecting a bonus event configuration, the gaming system displays a bonus event to the player (using the selected bonus event configuration) and determines a bonus event award for the triggered bonus event. In one embodiment, the bonus event utilizes one or more random determinations to determine a bonus event award to provide to the player. Thus, in this embodiment, the determined bonus event award is in accordance with, or otherwise based on, the bonus event average expected payout associated with the selected bonus event configuration and one or more random determinations. For example, a bonus event triggering condition occurs and the gaming system selects, based on the player's current wager and a quantity of accumulated bonus event points, a bonus event configuration which utilizes twelve free spins to determine a bonus event award to provide to the player. In this example, each of the twelve free spins of the bonus event are played and the gaming system provides the player a bonus event award of a determined amount.

After providing the player a bonus event award, the gaming system resets or otherwise subtracts the accumulated quantity of bonus event points to an initial or designated value. Thus, because the quantity of accumulated bonus event points is based on a player's gaming experience or gaming activity during a designated period of time, such as between bonus event triggering conditions, and these accumulated bonus event points are utilized in selecting, at least in part, the bonus event configuration (and thus the bonus event average expected payout) for a triggered bonus event, the gaming system provides players a bonus event award that, regardless of a player's current bet amount, is at least partially based on the player's gaming experience or gaming activity during a designated period of time, such as between bonus event triggering conditions. Accordingly, the gaming system and method disclosed herein provides players with a bonus event configuration which has a bonus event average expected payout that is based on both a current aspect of a player's gaming experience (i.e., a current wager) and one or more aspects of a player's previous gaming experiences (i.e., a player's coin-in over a designated period of time, such as between bonus event triggering conditions).

Additional features and advantages are described herein, and will be apparent from the following Detailed Description and the figures.

BRIEF DESCRIPTION OF THE FIGURES

FIG. 4A is a chart illustrating a plurality of bonus event configurations and the relationship between a player's current wager, a quantity of bonus event points, and these bonus event configurations.

FIG. 4B is a chart illustrating the plurality of bonus event average expected payout values associated with a plurality of bonus event configurations.

FIG. 6 is a table illustrating and example of the awards provided to a player for each play of the free spins bonus event.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
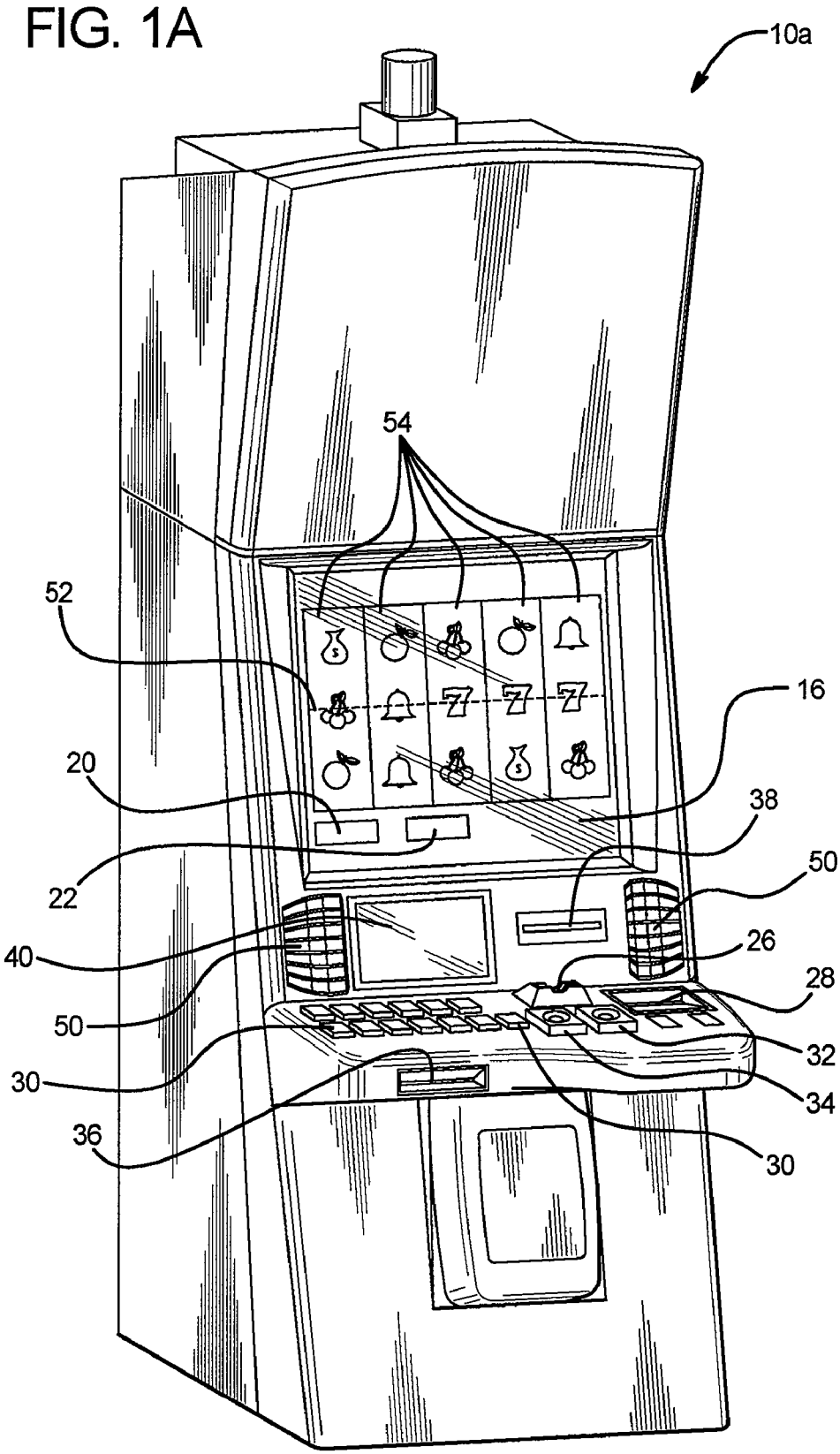
FIGS. 1A and 1B are front perspective views of alternative embodiments of gaming devices disclosed herein.
Figure 1B:
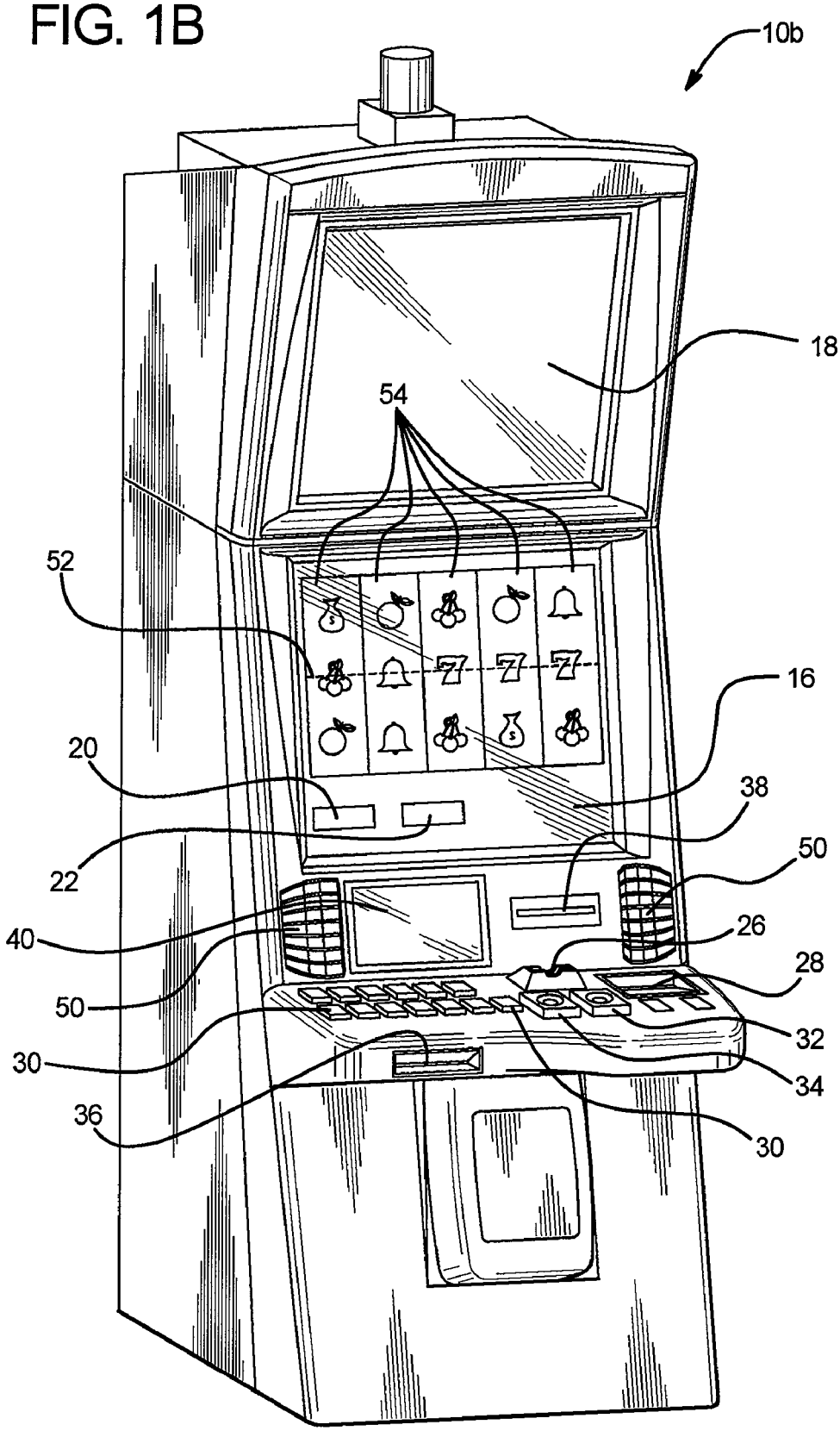

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
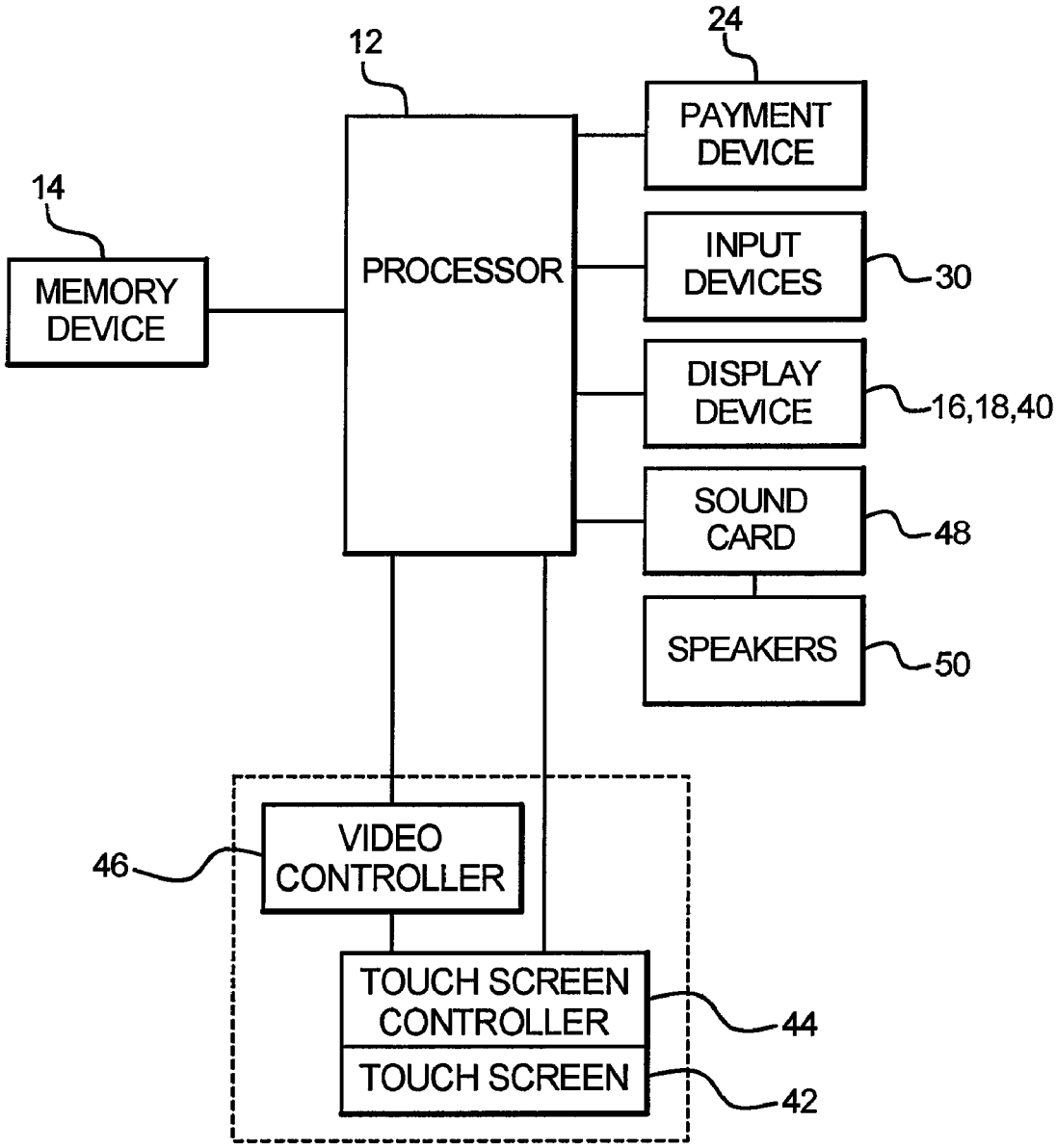
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
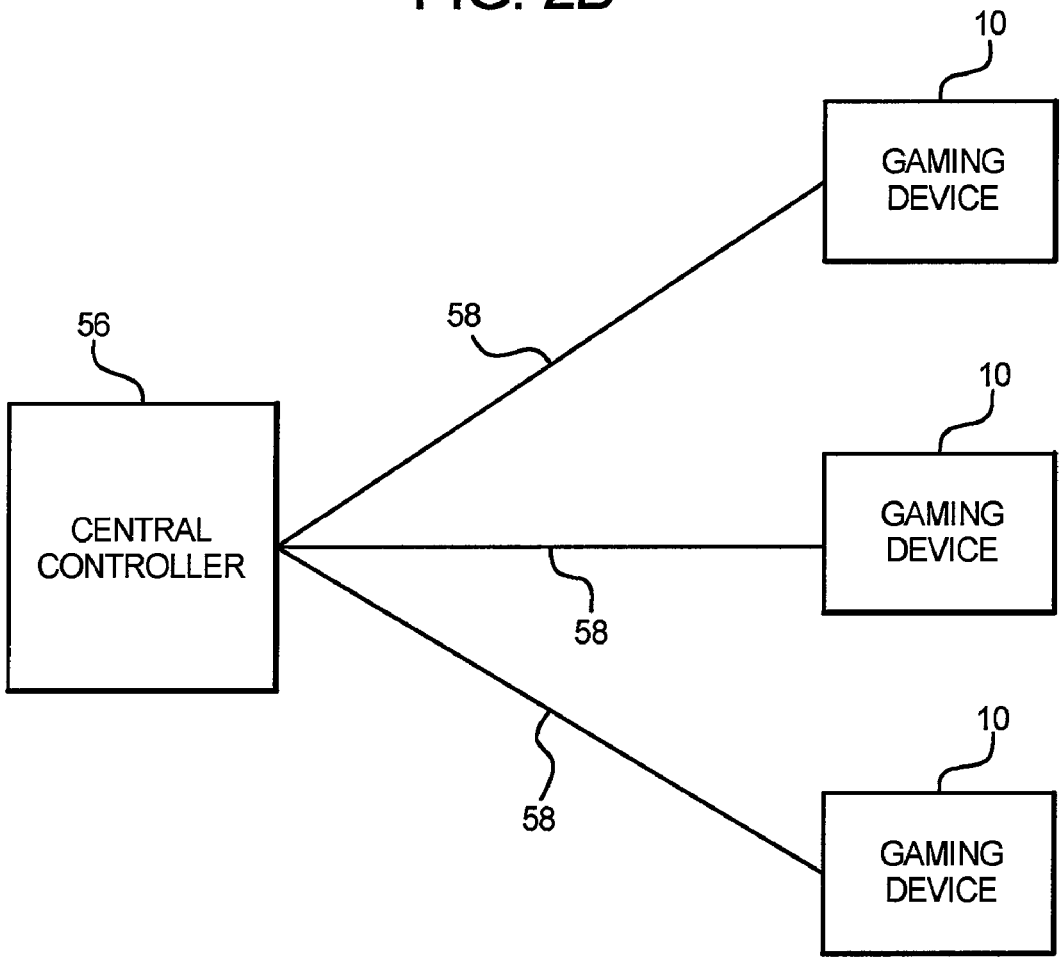
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Figure 3:
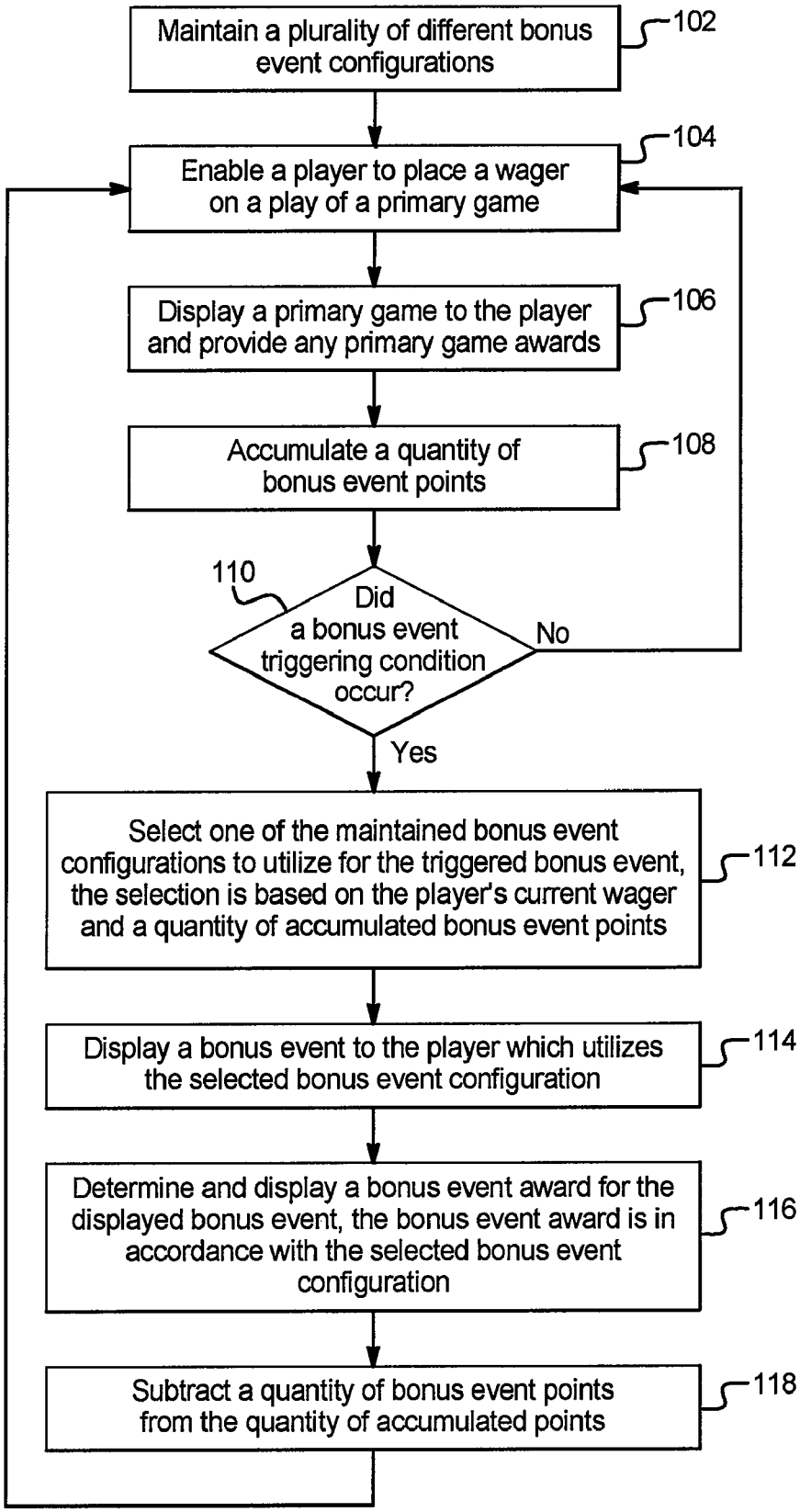
FIG. 3 is a flowchart of one embodiment of the gaming system disclosed herein and illustrating a primary game including an accumulation of bonus event points and a determination of a bonus event triggering condition, wherein a bonus event configuration is selected based on a player's current wager and the quantity of accumulated bonus event points.

Bonus Event Award in Accordance with a current wager and a quantity of Accumulated Bonus Event Points Referring now to FIG. 3, in operation of one embodiment, the gaming system maintains a plurality of different bonus event configurations as indicated in block 102. In one such embodiment, the plurality of different bonus event configurations are ranked or otherwise organized into a plurality of tiers based on the bonus event average expected payouts for each bonus event configuration. For example, as described below, the gaming system maintains a plurality of different quantities (or sets) of free spins, wherein each different quantity of free spins is associated with a bonus event average expected payout. In other words, each free spin is associated with an average expected payout (or theoretical value), such that a plurality of free spins have a total average expected payout (or total theoretical value).

In one embodiment, as discussed below, the value of the bonus event average expected payout for each bonus event configuration may or may not ultimately be provided to a player during the play of the bonus event configuration. In other words, if a bonus event triggering condition occurs and the gaming system selects one of the maintained bonus event configurations (e.g., one of the sets of free spins) for the triggered bonus event, because the actual value of a provided bonus event award is based, at least in part, on one or more random generations (e.g., one or more free spins) in the triggered bonus event, the actual value of the provided bonus event award is thus randomly determined, and may be different than the value of the bonus event average expected payout for the selected bonus event configuration. For example, if a selected bonus event configuration includes ten free spins and each free spin has an average expected payout of ninety cents, the bonus event average expected payout for this bonus event configuration is nine dollars. However, in this example, if these ten free spins result in a total award of twelve dollars, then the actual value of the bonus event award that is provided to the player is different than the value of the bonus event average expected payout for this selected bonus event configuration.

In one embodiment, the gaming system enables a player to place a wager to play a primary game as described above and as indicated in block 104. After the player places the wager, the gaming system displays a primary game and provides the player any awards for any winning outcomes in the primary game as indicated in block 106. In one embodiment, upon an occurrence of a bonus event point accumulation event, the gaming system accumulates a quantity of bonus event points as indicated by block 108.

In one embodiment, the gaming system causes a bonus event point accumulation event to occur and accumulates a quantity of bonus event points based on a displayed event in a play of one or more displayed games of one or more of the gaming devices in the gaming system. In another embodiment, the gaming system causes a bonus event point accumulation event to occur and accumulates a quantity of bonus event points independent of any displayed event in any play of any game of any of the gaming devices in the gaming system. In another embodiment, the gaming system causes a bonus event point accumulation event to occur and accumulates a quantity of bonus event points based on the occurrences of one or more suitable events occurring at or in association with one or more players and/or one or more gaming devices in the gaming system during a designated period of time, such as between bonus event triggering conditions. In another embodiment, the gaming system defines one or more game play parameters, wherein each time a player's tracked game play activity satisfies the defined parameter during a designated period of time, such as between bonus event triggering conditions, the gaming system causes a bonus event point accumulation event to occur and accumulates a quantity of bonus event points. In one embodiment, the gaming system utilizes one or more meters or counters to track (or monitor) the player's accumulated bonus event points.

In one embodiment as described herein, if a bonus event point accumulation event occurs, the gaming system accumulates one or more bonus event points (and maintains such accumulated bonus event points) for the specific player at the gaming device associated with the bonus event point accumulation event. In this embodiment, such accumulated bonus event points are associated with the player and may be transferred from gaming device to gaming device. In another embodiment, if a bonus event point accumulation event occurs, the gaming system accumulates one or more bonus event points (and maintains such accumulated bonus event points including reducing the balance of any accumulated bonus event points upon an occurrence of a bonus event point reduction event) for the gaming device associated with the bonus event point accumulation event. In this embodiment, such accumulated bonus event points are associated with the gaming device and independent of which player may be playing the gaming device at any given point in time.

In different embodiments, the quantity of bonus event points the gaming system accumulates is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

It should be appreciated that in one embodiment, the bonus event points disclosed herein are different, separate and independent from any monetary based points or credits, any promotional based points or credits, or any player tracking points. In other words, in this embodiment, the points disclosed herein are not directly redeemable for direct currency and are further not associated with a player's point balance in a player's player tracking account.

In addition to accumulating a quantity of bonus event points, the gaming system determines if a bonus event triggering condition has occurred as indicated by diamond 110. In one such embodiment, the gaming system causes a bonus event triggering condition to occur based on a displayed event in a play of one or more displayed games of one or more of the gaming devices in the gaming system. In another such embodiment, the gaming system causes a bonus event triggering condition to occur independent of any displayed event in any play of any game of any of the gaming devices in the gaming system. In another such embodiment, the gaming system causes a bonus event triggering condition to occur based on the occurrences of one or more suitable events occurring at or in association with one or more players and/or one or more gaming devices in the gaming system. In another such embodiment, the gaming system defines one or more game play parameters, wherein each time a player's tracked game play activity satisfies the defined parameter, the gaming system causes a bonus event triggering condition to occur.

In one embodiment, if a bonus event triggering condition does not occur, the gaming system does not trigger the bonus event. Rather, the gaming system returns to block 104 and enables the player to place a wager on another play of a primary game.

On the other hand, if a bonus event triggering condition occurs, the gaming system triggers a bonus event and selects a bonus event configuration from the plurality of maintained bonus event configurations to utilize in the triggered bonus event as indicated in block 112. In one embodiment, this selection is based on the player's current wager and a quantity of accumulated bonus event points as further indicated in block 112. That is, the gaming system utilizes or otherwise accounts for a player's current wager and past gaming experience (tracked by the gaming system as an accumulated quantity of bonus event points) when selecting a bonus event configuration to utilize in the triggered bonus event.

In one embodiment, the gaming system utilizes a chart or look-up table when selecting a bonus event configuration to utilize in the triggered bonus event. For example, as seen in FIG. 4A, the gaming system maintains a plurality of bonus event configurations as different quantities of free spins. In this example, if a bonus event triggering condition occurs, the gaming system determines which of these quantities of free spins to provide to the player for the triggered bonus event.

In one embodiment, the gaming system utilizes different bonus event configurations which have different bonus event average expected payouts for players that place the same wager with different quantities of accumulated bonus event points. In other words, in this embodiment, if a first player places a first wager with a first quantity of accumulated bonus event points, and a second player places the first wager with a second, different quantity of accumulated bonus event points and a bonus event triggering condition occurs, the gaming system provides the first and second players different bonus event configurations which have different bonus event average expected payouts. For example, utilizing the chart in FIG. 4A and the chart in FIG. 4B, if a first player places a wager of 50 credits with 150 accumulated bonus event points and a bonus event triggering condition occurs, the gaming system displays a first bonus event to the first player which utilizes a bonus event configuration of twelve free spins which has a bonus event average expected payout of $10.00. In this example, if a second player places a wager of 50 credits with 250 accumulated bonus event points and a bonus event triggering condition occurs, the gaming system displays a second bonus event to the second player which utilizes a bonus event configuration of thirteen free spins which has a bonus event average expected payout of $10.83.

In one embodiment, the gaming system additionally or alternatively utilizes different bonus event configurations for players that place different wagers with the same quantity of accumulated bonus event points. In other words, if a first player places a first wager with a first quantity of accumulated bonus event points, and a second player places a second, different wager with the first quantity of accumulated bonus event points and a bonus event triggering condition occurs, the gaming system utilizes different bonus event configurations which have different average expected payouts for the first and second players. For example, utilizing the chart in FIG. 4A and the chart in FIG. 4B, if a first player places a wager of 50 credits with 250 accumulated bonus event points and a bonus event triggering condition occurs, the gaming system displays a first bonus event to the first player which utilizes a first bonus event configuration of thirteen free spins which has a bonus event average expected payout of $10.83. On the other hand, in this example, if a second player places a wager of 100 credits with 250 accumulated bonus event points and a bonus event triggering condition occurs, the gaming system displays a second bonus event to the second player which utilizes a second, different bonus event configuration of twelve free spins which has a bonus event average expected payout of $20.00.

It should be appreciated that, in the above described example, the second player received a second, different bonus event configuration which has a smaller quantity of free spins for his larger wager. However, due, at least in part, to this larger wager, each free spin of the second bonus event configuration has a larger average expected payout (relative to the average expected payout of each free spin of the first bonus event configuration), such that this second bonus event configuration has a larger average expected payout (relative to the first bonus event configuration). In other words, as seen in this example, the values associated with the bonus event average expected payouts are based, at least in part, on the player's wager.

Referring back now to FIG. 3, after the gaming system selects one of the maintained bonus event configurations, the gaming system displays a bonus event which utilizes the selected bonus event configuration as indicated in block 114. In accordance with displaying the triggered bonus event to the player, the gaming system determines and displays a bonus event award to the player as indicated in block 116. In one embodiment, the actual bonus event award provided to the player is in accordance with or otherwise based on the selected bonus event configuration and its associated bonus event average expected payout.

After providing the player a bonus event award, the gaming system subtracts a quantity of bonus event points from the quantity of accumulated bonus event points as indicated in block 118. In different embodiments, as discuss below, the gaming system subtracts different quantities of bonus event points from the quantity of accumulated bonus event points in exchange for the selected bonus event configuration (and thus the provided bonus event award). It should be appreciated that by subtracting a quantity of bonus event points from the accumulated quantity of bonus event points, the gaming system selects a bonus event configuration based, at least in part, on that player's previous gaming experience or gaming activity. That is, by subtracting bonus event points from the accumulated quantity of bonus event points, the gaming system ensures that bonus event points that were utilized in selecting a previous bonus event configuration are not utilized in selecting a subsequent bonus event configuration. Such subtraction of bonus event points thus enables the gaming system to account for a player's previous gaming experience or gaming activity when selecting a subsequent bonus event configuration. Thus, if a player places relatively large wager amounts for a relatively long period of time, and subsequently switches to placing relatively small wager amounts and a bonus event triggering condition occurs while the player is placing a relatively small wager amount, the gaming system provides that the player's quantity of bonus event points (accumulated, at least in part, during the period of time that the player placed the relatively large wagers) determine, at least in part, which bonus event configuration the gaming system selects for the triggered bonus event.

Figure 5A:
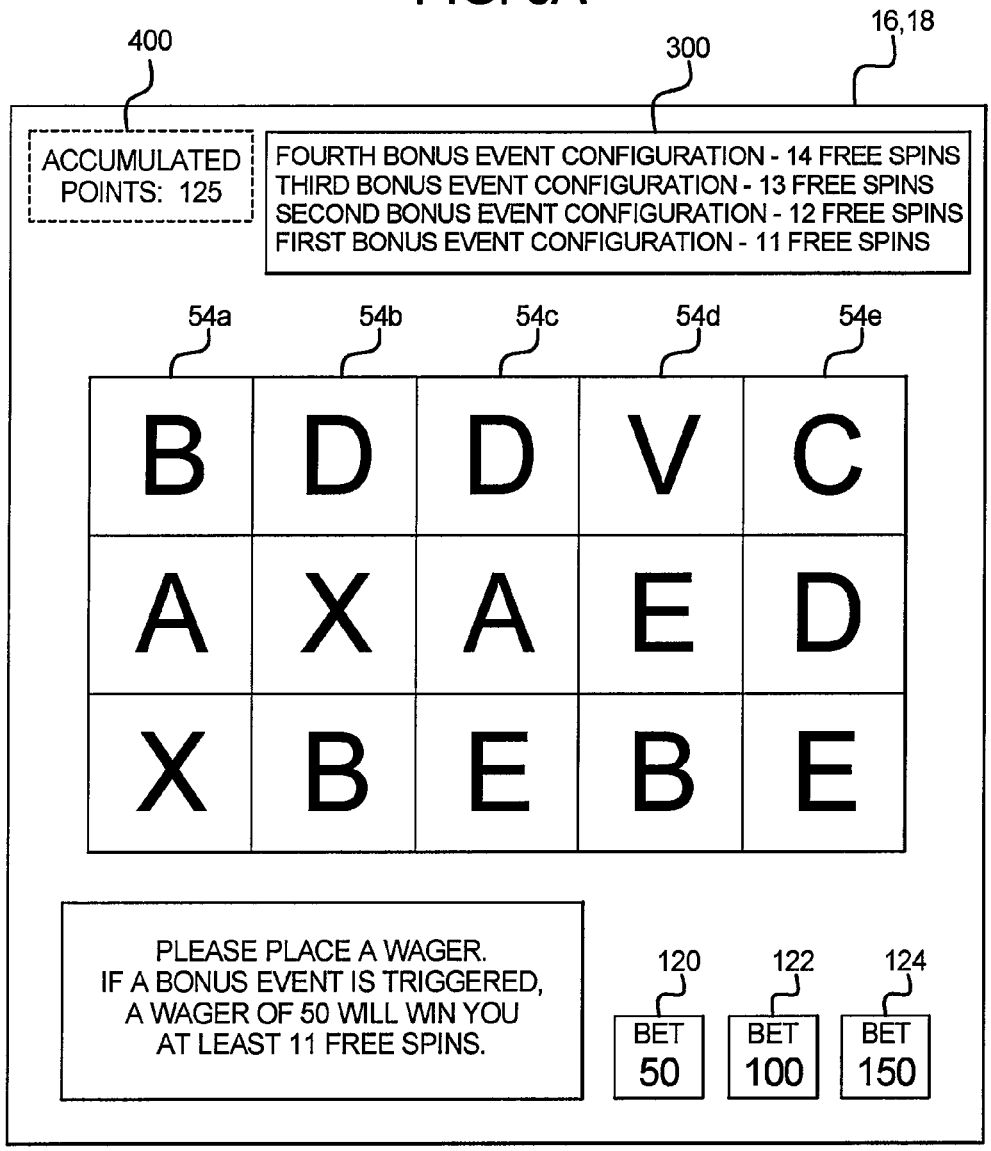
FIGS. 5A, 5B, and 5C are front perspective views of one embodiment of the gaming device disclosed herein illustrating a bonus event triggering condition and a free spins bonus event.

Referring now to FIG. 5A, in one example of the above described embodiment, the gaming system maintains a plurality of bonus event configurations as different quantities of free spins and displays them in bonus event award indicator 300. The gaming system enables the player to place a wager using wager input devices 120, 122, and 124. In this example, the gaming system displays appropriate messages such as "PLEASE PLACE A WAGER" and "IF A BONUS EVENT IS TRIGGERED, A WAGER OF 50 WILL WIN YOU AT LEAST 11 FREE SPINS" to the player visually, or through suitable audio or audiovisual displays. It should be appreciated that, in one embodiment, prior to the player placing a wager, the gaming system determines, based on the quantity of accumulated bonus event points, a minimum selectable tier (or level) bonus event configuration.

Figure 5B:
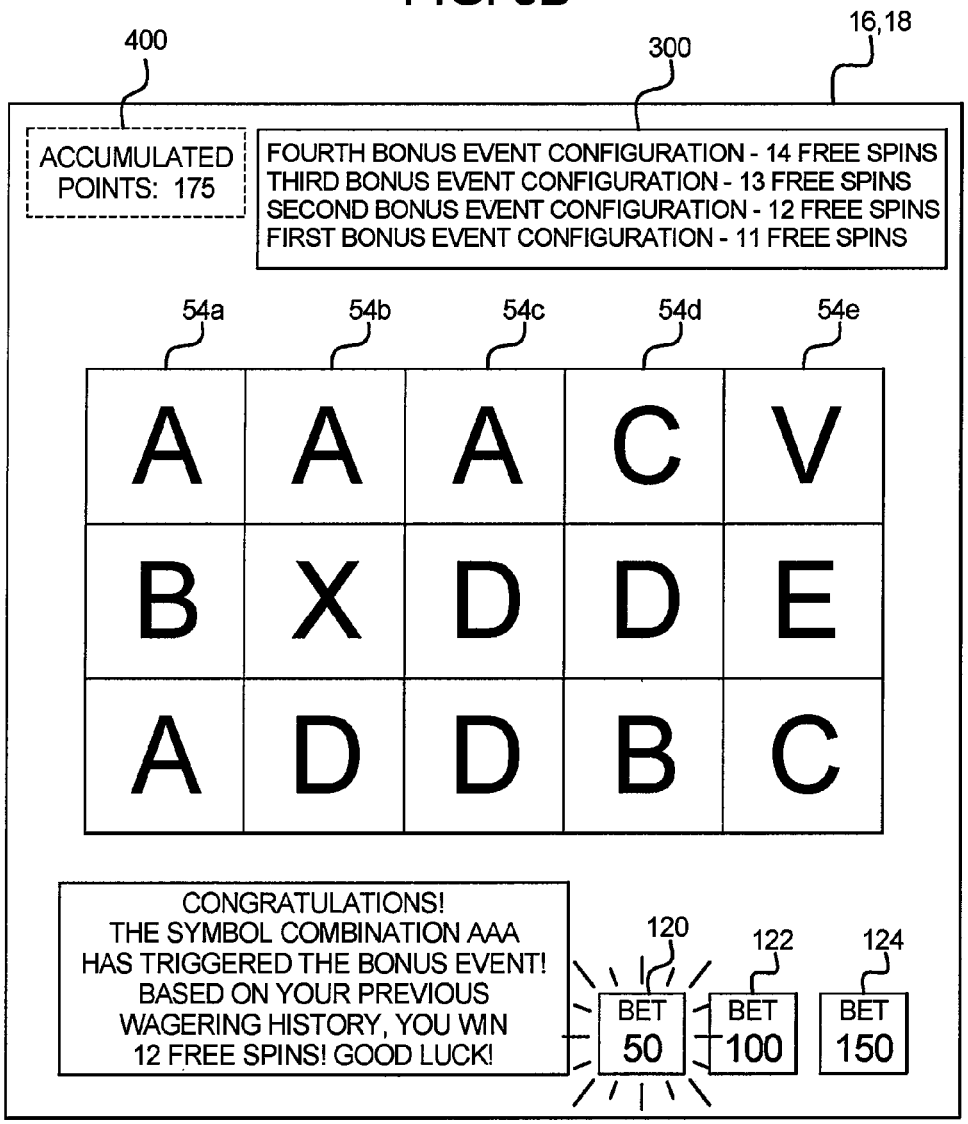

As illustrated in FIG. 5B, the player places a wager of 50 credits by selecting input selection device 120. After the player places the wager, the gaming system generates and displays a plurality of symbols, wherein an A-A-A symbol combination is displayed in the top row of reels 54*a*, 54*b*, and 54*c*. In this illustrated example, the gaming system then triggers a bonus event because the A-A-A symbol combination is determined to be a bonus event triggering condition. Upon the triggering of the bonus event, the gaming system selects one of the maintained bonus event configurations for the triggered bonus event, wherein the selection is based on the player's current wager and the quantity of accumulated bonus event points. For example, utilizing the chart illustrated in FIG. 4A and the chart illustrated in FIG. 4B, basing the selection of the bonus event configuration on the player's current wager of 50 credits and the 175 accumulated bonus event points (displayed in phantom in FIG. 5B in indicator 400), the gaming system selects a bonus event configuration of twelve free spins which has a bonus event average expected payout of $10.00. It should be appreciated that while the tracked quantity of accumulated bonus event points are not displayed to the player in this illustrated example, in other embodiments, the gaming system displays the tracked quantity of accumulated bonus event points to the player.

It should be appreciated that, in this example, while the accumulated quantity of 125 bonus event points (illustrated in phantom in box 400 of FIG. 5A), which have been accumulated prior to the player placing the wager of 50 credits, guarantees the selection of a bonus event configuration of at least eleven free spins if a bonus event triggering condition occurs, the gaming system provides the player a bonus event configuration of twelve free spins due, at least in part, to the accumulated quantity of bonus event points. Accordingly, as seen in FIG. 5B, gaming system displays appropriate messages such as "BASED ON YOUR PREVIOUS WAGERING HISTORY, YOU WIN 12 FREE SPINS! GOOD LUCK!" to the player visually, or through suitable audio or audiovisual displays.

Figure 5C:
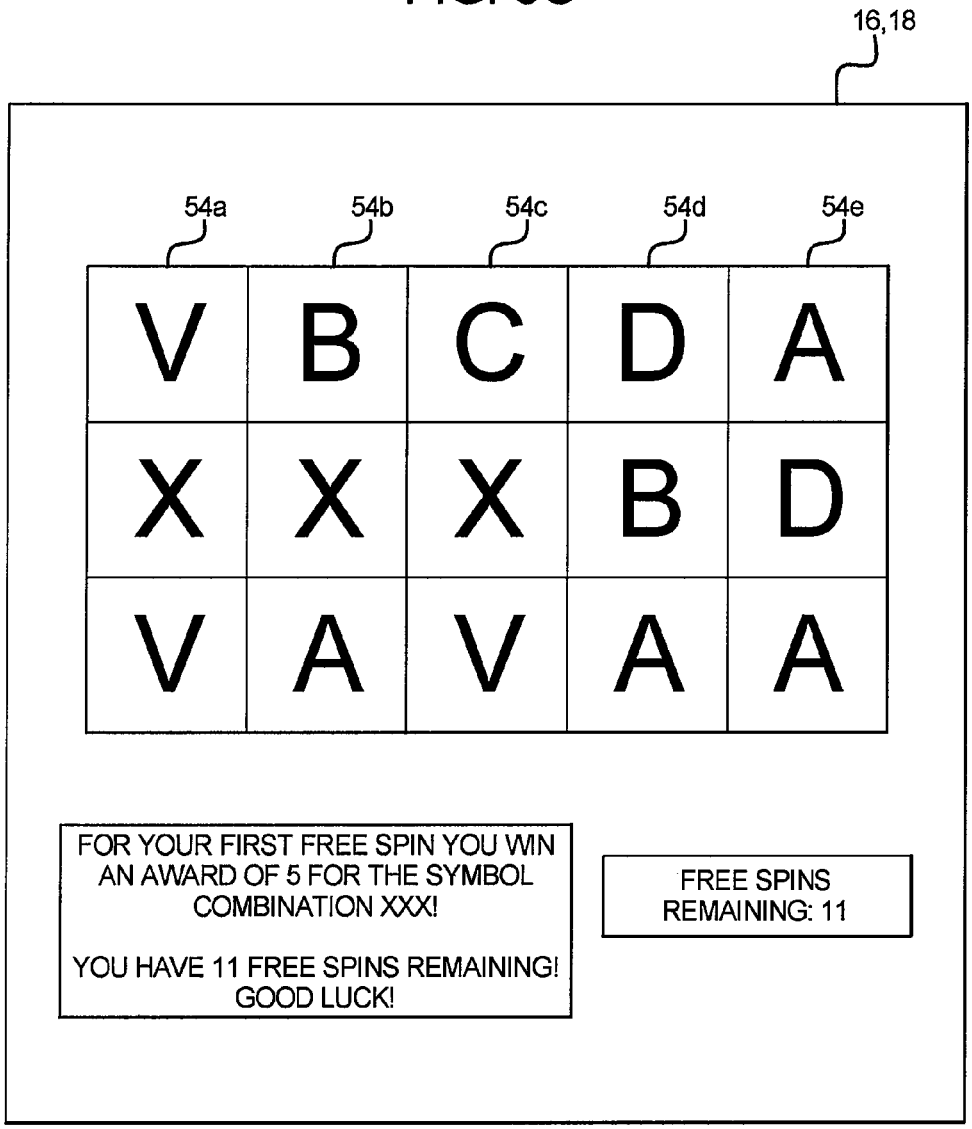

As seen in FIG. 5C, after selecting the bonus event configuration for the triggered bonus event, the gaming system displays the bonus event to the player and determines a bonus event award. Upon the first free spin of the bonus event, the gaming system provides the player an award of 5 for the symbol combination X-X-X. Accordingly, the gaming system displays appropriate messages such as "FOR YOUR FIRST FREE SPIN YOU WIN AN AWARD OF 5 FOR THE SYMBOL COMBINATION X-X-X!" and "YOU HAVE 11 FREE SPINS REMAINING! GOOK LUCK!" to the player visually, or through suitable audio or audiovisual displays.

The gaming system continues providing the player free spins until no free spins remain in the bonus event. After providing each of the free spins to the player, the gaming system provides the player a bonus event award which is in accordance with the results of the provided free spins. FIG. 6. illustrates the payout of each free spin of the above illustrated bonus event and the total bonus event award provided to the player. It should be appreciated that, in this illustrated example, the gaming system provides the player a bonus event award of $16.00, which is larger than the $10.00 value of the selected bonus event average expected payout.

Figure 7:
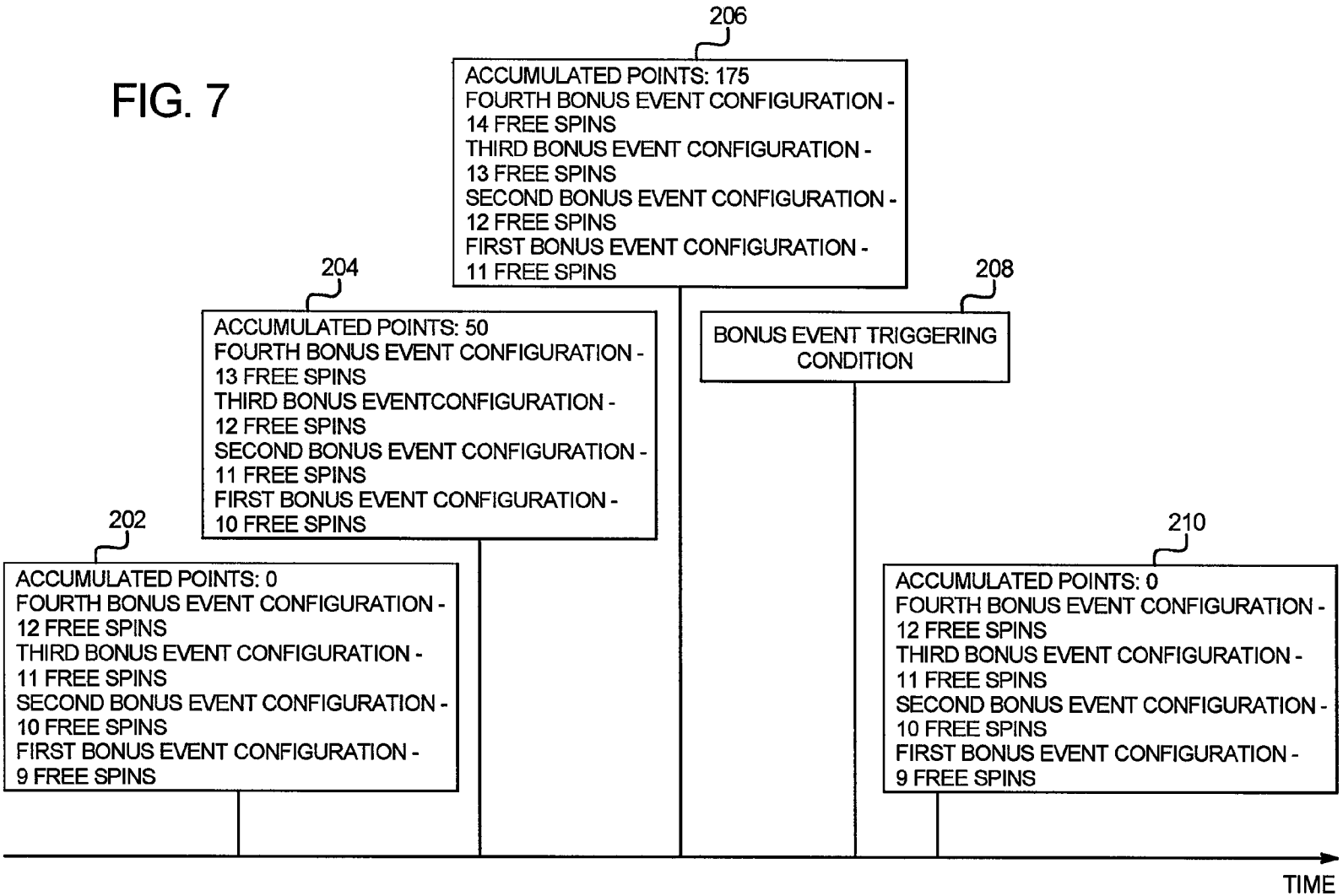
FIG. 7 timeline of the operation of one embodiment of the gaming system disclosed herein, illustrating the relationship between different points in time and the corresponding quantity of accumulated bonus event points and bonus event configurations at these different points in time.

In one embodiment, the gaming system increments one or more of the bonus event configurations in a progressive fashion as disclosed herein. For example, as seen in FIG. 7, at a first point in time 202, a first bonus event configuration utilizes nine free spins to determine a bonus event award to provide to a player in a triggered bonus event, and at a second, different point in time 204, the first bonus event configuration utilizes ten free spins to determine a bonus event award to provide to a player for the triggered bonus event. In one embodiment, the gaming system continues to increment one or more of the bonus event configurations in this progressive fashion until a bonus event triggering conditions occurs. Once a bonus event triggering condition occurs, the gaming system resets one or more of the bonus event configurations to an initial or designated value. It should be appreciated that in this embodiment, the average expected payout of each free spin in the bonus event configuration does not change (i.e., the values associated with the possible winning symbol combinations do not increment).

In one embodiment, if a bonus event triggering condition occurs, as described above, the gaming system resets (or subtracts) the quantity of accumulated bonus event points to an initial or designated quantity. For example, as seen in FIG. 7, at point in time 206, 175 bonus event points have been accumulated. At point in time 208, a bonus event triggering condition occurs. Accordingly, at point in time 210, the quantity of accumulated bonus event points are reset to zero.

It should be appreciated that, in different embodiments, the gaming system subtracts different quantities of bonus event points from the quantity of accumulated bonus event points. In one embodiment, the quantity of bonus event points subtracted from the quantity of accumulated bonus event points is different than the quantity of points associated with a selected bonus event configuration. In one such embodiment, the gaming system resets the accumulated quantity of bonus event points (i.e., reduces the quantity to zero). For example, at point in time 206 in FIG. 7, 175 bonus event points have been accumulated. At point in time 208, a bonus event triggering condition occurs and the gaming system selects a bonus event configuration and provides the player a bonus event award. Accordingly, as seen at point in time 210, the quantity of accumulated bonus event points is reset to zero.

In another embodiment, the quantity of bonus event points the gaming system subtracts from the accumulated quantity of bonus event points is equivalent to the quantity of bonus event points associated with the selected bonus event configuration. For example, as discussed above, for a wager of 50 credits, a bonus event configuration of twelve free spins requires a minimum of 100 bonus event points. Thus, if a player places a wager of 50 credits with 175 bonus event points and a bonus event triggering condition occurs, the gaming system selects a bonus event configuration of twelve free spins and subtracts 100 bonus event points from the accumulated quantity of 175 bonus event points. Accordingly, a balance of 75 bonus event points are maintained.

In different embodiments, the quantity of bonus event points the gaming system determines to subtract from the quantity of accumulated points is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, if the gaming system utilizes one or more meters or counters to track or accumulate bonus event points and a bonus event triggering condition occurs, the gaming system utilizes a different meter or counter to track or accumulate any subsequent bonus event points. In other words, if the gaming system utilizes a first meter or counter to track or accumulate bonus event points and a bonus event triggering condition occurs, the gaming system utilizes a second, different meter or counter to track or accumulate any subsequent bonus event points for subsequent bonus events. It should be appreciated that, in one embodiment, resetting a meter or counter to track or accumulate subsequent bonus event points is considered the same function as subtracting points from that meter or counter.

In one embodiment, each of the maintained bonus event configurations is associated with a separate primary game paytable. In this embodiment, for one or more plays of a primary game, the gaming system utilizes the primary game paytable associated with the selected bonus event configuration. That is, this embodiment provides that one or more aspects of one or more plays of a primary game are based on the bonus event configuration selected. In one such embodiment, a plurality of such separate primary game paytables each include the same designated winning symbol combination. In this embodiment, the designated winning symbol combination is associated with different values according to the different paytables associated with the separate bonus event configurations.

In another embodiment, one or more designated winning symbol combinations are associated with a value that increments in a progressive fashion as disclosed herein. In one embodiment, if one of these designated winning symbol combinations are generated during a play of the game, the award associated with this generated winning symbol combination is provided to the player. Accordingly, the value of the award provided for such designated winning symbol combinations are reduced a designated amount. For example, at a first point in time, a first designated winning symbol combination has an award value of 10 and a second designated winning symbol combination has an award value of 15. At a second, subsequent point in time, the first designated winning symbol combination has an award value of 15 and the second designated winning symbol combination has an award value of 20. At a third point in time, the first designated winning symbol combination is generated and an award of 15 is provided to the player. Accordingly, the first designated winning symbol combination is reduced to being associated with a value of 13 and the second designated winning symbol combination is reduced to being associated with a value of 18.

It should be appreciated that any suitable manner of providing a bonus event to the player may be incorporated in the gaming system disclosed herein. That is, any suitable primary game or secondary game may be utilized as the triggered bonus event to provide one or more of the players of the gaming devices of the gaming system with a bonus event award. In different embodiments, the bonus event award may incorporate any of the types of games described herein, as well as any suitable puzzle-type game, any suitable persistence game, any suitable wheel game, any suitable selection game, any suitable offer and acceptance game, any suitable cascading symbols game, any suitable ways to win game, any suitable scatter pay game, any suitable group game or any other suitable type of game. In different embodiments, the type of game utilized for a triggered bonus event is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In different embodiments, the characteristics or features of each triggered bonus event is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on a player's primary game wager, determined based on time (such as the time of day), determined based on an amount of coin-in accumulated in one or more pools or determined based on any other suitable method or criteria.

In another embodiment, if a bonus event triggering condition occurs, the gaming system enables the player to select one of the maintained plurality of bonus event average expected payouts. For example, if a bonus event triggering condition occurs, the gaming system displays to the player the maintained plurality of bonus event configurations and enables the player to make a selection of one of the plurality of bonus event configurations for the triggered bonus event.

In one embodiment, the gaming system is configured to maintain a progressive award. As described above, the progressive award is incremented based on any wagers placed at one or more gaming devices. In one embodiment, if a bonus event triggering condition occurs, the gaming system selects a bonus event configuration for the triggered bonus event. In this embodiment, the bonus event average expected payout of this selected bonus event configuration is based on the maintained progressive award. For example, if a progressive award is currently valued at $1000 and a bonus event triggering condition occurs, the gaming system selects a bonus event configuration, wherein the bonus event average expected payout of this selected bonus event configuration is $1000. After selecting the bonus event configuration, the gaming system determines and displays a bonus event award to the player, wherein the bonus event award is in accordance with the bonus event average expected payout of the selected bonus event configuration and one or more random determinations. For example, based on the bonus event average expected payout of $1000 and one or more random determinations, the gaming system provides a player a bonus event award of $1200.

In different embodiments of the gaming system disclosed herein, a bonus event triggering condition occurs and/or a bonus event point accumulation event occurs based on an amount coin-in during a designated period of time, such as between bonus event triggering conditions. In this embodiment, the gaming system determines if an amount of coin-in wagered at one or more gaming devices in the gaming system reaches or exceeds a designated amount of coin-in (i.e., a threshold coin-in amount) during a designated period of time, such as between bonus event triggering conditions. Upon the amount of coin-in wagered at one or more gaming devices in the gaming system reaching or exceeding the bonus threshold coin-in amount during a designated period of time, such as between bonus event triggering conditions, the gaming system causes one or more of such events or conditions to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In different embodiments of the gaming system disclosed herein, a bonus event triggering condition occurs and/or a bonus event point accumulation event occurs based on an amount coin-out during a designated period of time, such as between bonus event triggering conditions. In this embodiment, the gaming system determines if an amount of coin-out provided by one or more gaming devices in the gaming system reaches or exceeds a designated amount of coin-out (i.e., a threshold coin-out amount) during a designated period of time, such as between bonus event triggering conditions. Upon the amount of coin-out provided at one or more gaming devices in the gaming system reaching or exceeding the threshold coin-out amount during a designated period of time, such as between bonus event triggering conditions, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In different embodiments of the gaming system disclosed herein, a bonus event triggering condition occurs and/or a bonus event point accumulation event occurs based on a predefined variable reaching a defined parameter threshold during a designated period of time, such as between bonus event triggering conditions. For example, when the $500{,}000^{th}$ player has played a gaming machine of the gaming system (ascertained from a player tracking system), one or more of such events or conditions occur. In different embodiments, the predefined parameter thresholds include a designated length of time, a designated length of time after a certain dollar amount is hit, a designated wager level threshold for a specific machine (which gaming device is the first to contribute $250,000), a designated number of gaming machines active, or any other designated parameter that defines a designated suitable threshold.

In different embodiments of the gaming system disclosed herein, a bonus event triggering condition occurs and/or a bonus event point accumulation event occurs based on a designated amount of elapsed time. In this embodiment, a time in the future is set for when one or more of such events or conditions will occur. In one embodiment, such a set time is based on historic data.

In different embodiments of the gaming system disclosed herein, a bonus event triggering condition occurs and/or a bonus event point accumulation event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the central controller/gaming device processor recognizes the player's identification (via the player tracking system) when the player inserts or otherwise associates their player tracking card in the gaming machine. The central server/gaming device processor determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments of the gaming system disclosed herein, a bonus event triggering condition occurs and/or a bonus event point accumulation event occurs based on a system determination, including one or more random selections by the central controller. In one embodiment, as described above, the central controller tracks all active gaming machines and the wagers they placed. Each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. In one such embodiment, based on the gaming machine's state as well as one or more wager pools associated with the gaming machine, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments of the gaming system disclosed herein, a bonus event triggering condition occurs and/or a bonus event point accumulation event occurs based on a determination of if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing one or more bonus event elements to be provided may be implemented in accordance with the gaming system and method disclosed herein.

Information Provided to Player

As indicated above, suitable information about the bonus event point accumulation event can be provided to the players through one or more displays on the gaming machines or additional information displays positioned near the gaming machines, such as above a bank of system gaming machines. In one embodiment, a metering and/or information display device may be used to display information regarding the bonus event point accumulation events. This information can be used to entertain the player or inform the player that a bonus event point accumulation event has occurred or will occur. Examples of such information are:

(1) that a bonus event point accumulation event has occurred;

(2) that a bonus event point accumulation event will shortly occur (i.e., foreshadowing the providing of a quantity of bonus event points);

(3) that one or more bonus event points have been provided to one or more players of the system gaming machines;

(4) which players have accumulated bonus event points;

(5) the amount of the bonus event points accumulated;

(6) the highest quantity of bonus event points accumulated;

(7) the lowest quantity of bonus event points accumulated;

(8) the average quantity of bonus event points accumulated;

(9) number of games played/total time since the last bonus event point accumulation event has occurred;

(10) the number of bonus event points accumulated in a designated time period;

(11) an average amount of time between each bonus event point accumulation event occurring;

(12) that a bonus event has occurred;

(13) that a bonus event will shortly occur (i.e., foreshadowing the providing of a bonus event award in a bonus event);

(14) an award provided in association with a bonus event;

(15) which players have won awards in association with a bonus event;

(16) the amount of the awards won in association with a bonus event;

(17) the highest award won in association with a bonus event;

(18) the average award won in association with a bonus event; and

(19) an average amount of time between each bonus event occurring.

It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) maintain: (A) a balance of accumulated bonus event points and (B) a plurality of different bonus event configurations, wherein each of said maintained bonus event configurations is associated with a bonus event average expected payout;

(b) enable a player to place a wager on each of a plurality of plays of a primary game;

(c) accumulate a quantity of bonus event points;

(d) display said plurality of primary games to the player and provide the player any primary game awards for any designated winning outcomes in any of said plurality of primary games; and (e) for one of the plays of the primary game, if a bonus event triggering condition occurs in association with said play of the primary game:

(i) select one of said maintained plurality of different bonus event configurations for the triggered bonus event, said selection based on: (A) the wager placed on said play of the primary game, and (B) said maintained balance of accumulated bonus event points, (ii) randomly determine and display a bonus event award for the triggered bonus event, said bonus event award is in accordance with said bonus event average expected payout of said selected bonus event configuration and at least one random determination, (iii) provide the player the determined bonus event award, and (iv) subtract a quantity of bonus event points from said maintained balance of accumulated bonus event points, said quantity of bonus event points subtracted is based on the selected bonus game configuration.

2. The gaming system of claim 1, wherein when executed by the at least one processor, said plurality of instructions cause the at least one processor to operate with the at least one display device to repeat (b) to (e)(iv) at least once.

3. The gaming system of claim 1, wherein the maintained balance of accumulated bonus event points is stored by a second memory device distinct from said at least one memory device.

4. The gaming system of claim 1, wherein the quantity of bonus event points accumulated is based on the wager placed.

5. The gaming system of claim 1, wherein the bonus event triggering condition occurs based on at least one displayed event in the play of the primary game.

6. The gaming system of claim 1, wherein the bonus event triggering condition occurs independent of any displayed event in any play of the primary game and independent of any plays of any triggered bonus events.

7. The gaming system of claim 1, wherein the quantity of bonus event points subtracted is based on the determined bonus event award in the triggered bonus event.

8. The gaming system of claim 1, wherein said selected bonus event configuration includes a plurality of free spins.

9. The gaming system of claim 8, wherein when executed by the at least one processor, said plurality of instructions cause the at least one processor to operate with the at least one display device to, for each free spin of the selected bonus event configuration, randomly determine and display a free spin game outcome and provide the player any awards for any displayed designated winning free spin game outcomes.

10. The gaming system of claim 1, wherein when executed by the at least one processor, said plurality of instructions cause the at least one processor to operate with the at least one display device to:

(1) upon a first occurrence of the bonus event triggering condition, select a first one of the maintained plurality of different bonus event configurations, said selection based on a first one of the placed wagers and a first balance of accumulated bonus event points, randomly determine and display a first bonus event award, said first bonus event award is in accordance with the bonus event average expected payout of said selected first one of the maintained plurality of different bonus event configurations and at least one random determination, and provide the player said first bonus event award, and (2) upon a second occurrence of the bonus event triggering condition, select a second, different one of the maintained plurality of different bonus event configurations, said selection based on a second, different one of the placed wagers and said first balance of accumulated bonus event points, randomly determine and display a second bonus event award, said second bonus event award is in accordance with the bonus event average expected payout of said selected second, different one of the maintained plurality of different bonus event configurations and at least one random determination, and provide the player said second bonus event award.

11. The gaming system of claim 10, wherein said first bonus event award has a same value as a value of said second bonus event award.

12. The gaming system of claim 1, wherein when executed by the at least one processor, said plurality of instructions cause the at least one processor to operate with the at least one display device to:

(1) upon a first occurrence of the bonus event triggering condition, select a first one of the maintained plurality of different bonus event configurations, said selection based on a first one of the placed wagers and a first balance of accumulated bonus event points, randomly determine and display a first bonus event award, said first bonus event award is in accordance with the bonus event average expected payout of said selected first one of the maintained plurality of different bonus event configurations and at least one random determination, and provide the player said first bonus event award, and (2) upon a second occurrence of the bonus event triggering condition, select a second, different one of the maintained plurality of different bonus event configurations, said selection based on said first one of the placed wagers and a second, different balance of accumulated bonus event points, randomly determine and display a second bonus event award, said second bonus event award is in accordance with the bonus event average expected payout of said selected second, different one of the bonus event configurations and at least one random determination, and provide the player said second bonus event award.

13. The gaming system of claim 12, wherein said first bonus event award has a same value as a value of said second bonus event award.

14. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) maintain a plurality of different bonus event configurations, each of said maintained bonus event configurations is associated with a bonus event average expected payout;

(b) maintain a balance of accumulated bonus event points for a player;

(c) enable the player to place a wager on each of a plurality of plays of a primary game;

(d) accumulate a quantity of bonus event points for the player;

(e) display said plurality of primary games to the player and provide the player any primary game awards for any designated winning outcomes in any of said plurality of primary games; and (f) for one of the plays of the primary game, if a bonus event triggering condition occurs in association with the play of the said primary game:

(i) select one of said maintained plurality of different bonus event configurations for the triggered bonus event, said selection based on (A) the wager placed on said play of the primary game and (B) the balance of accumulated bonus event points maintained for the player, (ii) randomly determine and display a bonus event award for the triggered bonus event, said bonus event award is in accordance with said bonus event average expected payout of said selected bonus event configuration and at least one random determination, (iii) provide the player the determined bonus event award, and (iv) subtract a quantity of bonus event points from the balance of accumulated bonus event points maintained for the player, said quantity of bonus event points subtracted is based on the selected bonus game configuration.

15. The gaming system of claim 14, wherein when executed by the at least one processor, said plurality of instructions cause the at least one processor to operate with the at least one display device to repeat (c) to (f)(iv) at least once.

16. The gaming system of claim 14, wherein the balance of accumulated bonus event points maintained for the player is stored on a player tracking card.

17. The gaming system of claim 14, wherein the quantity of bonus event points accumulated for the player is based on the wager placed.

18. The gaming system of claim 14, wherein the bonus event triggering condition occurs based on at least one displayed event in a play of the primary game.

19. The gaming system of claim 14, wherein the bonus event triggering condition occurs independent of any displayed event in any play of the primary game and independent of any plays of any triggered bonus events.

20. The gaming system of claim 14, wherein the quantity of bonus event points subtracted is based on the determined bonus event award in the triggered bonus event.

21. The gaming system of claim 14, wherein said selected bonus event configuration includes a plurality of free spins.

22. The gaming system of claim 21, wherein when executed by the at least one processor, said plurality of instructions cause the at least one processor to operate with the at least one display device to, for each free spin of the selected bonus event configuration, randomly determine and display a free spin game outcome and cause any awards for any displayed designated winning free spin game outcomes.

23. The gaming system of claim 14, wherein when executed by the at least one processor, said plurality of instructions cause the at least one processor to operate with the at least one display device to:

(1) upon a first occurrence of the bonus event triggering condition, select a first one of the maintained plurality of different bonus event configurations, said selection based on a first one of the placed wagers and a first balance of accumulated bonus event points, randomly determine and display a first bonus event award, said first bonus event award is in accordance with the bonus event average expected payout of said selected first one of the maintained plurality of different bonus event configurations and at least one random determination, and provide the player said first bonus event award, and (2) upon a second occurrence of the bonus event triggering condition, select a second, different one of the maintained plurality of different bonus event configurations, said selection based on a second, different one of the placed wagers and said first balance of accumulated bonus event points, randomly determine and display a second bonus event award, said second bonus event award is in accordance with the bonus event average expected payout of said selected second, different one of the maintained plurality of different bonus event configurations and at least one random determination, and provide the player said second bonus event award.

24. The gaming system of claim 23, wherein said first bonus event award has a same value as a value of said second bonus event award.

25. The gaming system of claim 14, wherein when executed by the at least one processor, said plurality of instructions cause the at least one processor to operate with the at least one display device to:

(1) upon a first occurrence of the bonus event triggering condition, select a first one of the maintained plurality of different bonus event configurations, said selection based on a first one of the placed wagers and a first balance of accumulated bonus event points, randomly determine and display a first bonus event award, said first bonus event award is in accordance with the bonus event average expected payout of said selected first one of the maintained plurality of different bonus event configurations and at least one random determination, and provide the player said first bonus event award, and (2) upon a second occurrence of the bonus event triggering condition, select a second, different one of the maintained plurality of different bonus event configurations, said selection based on said first wager amount and a second, different balance of accumulated bonus event points, randomly determine and display a second bonus event award, said second bonus event award is in accordance with the bonus event average expected payout of said selected second, different one of the bonus event configurations and at least one random determination, and provide the player said second bonus event award.

26. The gaming system of claim 25, wherein said first bonus event award has a same value as a value of said second bonus event award.

* * * * *

UNITED STATES PATENT AND TRADEMARK OFFICE

CERTIFICATE OF CORRECTION

PATENT NO. : 8,152,630 B2
APPLICATION NO. : 12/270065
DATED : April 10, 2012
INVENTOR(S) : Alexander Casey Naglestad Cohen It is certified that error appears in the above-identified patent and that said Letters Patent is hereby corrected as shown below:

IN THE CLAIMS

In Claim 1, Column 30, Line 66, between "of" and "primary" insert --plays of the-- and replace "games" with --game--.
In Claim 1, Column 31, Line 2, between "of" and "primary" insert --plays of the-- and replace "games" with --game--.
In Claim 1, Column 31, Line 14, replace "is" with --being--.
In Claim 1, Column 31, Line 24, replace "is" with --being--.
In Claim 10, Column 31, Line 65, replace "is" with --being--.
In Claim 10, Column 32, Line 10, replace "is" with --being--.
In Claim 12, Column 32, Lines 29 and 41, replace "is" with --being--.
In Claim 14, Column 32, Line 60, replace "is" with --being--.
In Claim 14, Column 33, Line 1, between "of" and "primary" insert --plays of the-- and replace "games" with --game--.
In Claim 14, Column 33, Line 4, between "of" and "primary" insert --plays of the-- and replace "games" with --game--.
In Claim 14, Column 33, Line 16, replace "is" with --being--.
In Claim 14, Column 33, Line 25, replace "is" with --being--.
In Claim 18, Column 33, Line 40, replace "a" with --the--.
In Claim 23, Column 34, Lines 9 and 21, replace "is" with --being--.
In Claim 25, Column 34, Lines 39 and 50, replace "is" with --being--.

Signed and Sealed this
Fourteenth Day of August, 2012

David J. Kappos

David J. Kappos
*Director of the United States Patent and Trademark Office*